US005242572A

United States Patent [19]

Shindou et al.

[11] Patent Number: 5,242,572

[45] Date of Patent: Sep. 7, 1993

[54] COATED STEEL SHEETS AND PROCESS FOR PRODUCING THE SAME

[75] Inventors: Yoshio Shindou; Fumio Yamazaki, both of Kimitsu, Japan

[73] Assignee: Nippon Steel Corporation, Japan

[21] Appl. No.: 901,033

[22] Filed: Jun. 19, 1992

Related U.S. Application Data

[63] Continuation-in-part of Ser. No. 642,541, Jan. 29, 1991, which is a continuation of Ser. No. 350,032, May 10, 1989, abandoned.

[30] Foreign Application Priority Data

| | | | |
|---|---|---|---|
| May 17, 1988 | [JP] | Japan | 63-118118 |
| May 17, 1988 | [JP] | Japan | 63-118119 |
| Jun. 7, 1988 | [JP] | Japan | 63-138319 |
| Jul. 29, 1988 | [JP] | Japan | 63-191521 |
| Sep. 19, 1988 | [JP] | Japan | 63-232265 |
| Sep. 19, 1988 | [JP] | Japan | 63-232266 |

[51] Int. Cl.[5] ..... C25D 3/56

[52] U.S. Cl. ..... 205/244; 205/245

[58] Field of Search ..... 205/244, 245

[56] References Cited

U.S. PATENT DOCUMENTS

| | | | |
|---|---|---|---|
| 3,985,584 | 10/1976 | Chan et al. | 148/6.16 |
| 4,561,952 | 12/1985 | Mels et al. | 204/181.7 |
| 4,707,415 | 11/1987 | Ikeda et al. | 428/621 |
| 4,756,975 | 7/1988 | Fujii | 428/461 |

FOREIGN PATENT DOCUMENTS

| | | |
|---|---|---|
| 182964 | 6/1986 | European Pat. Off. . |
| 2145818 | 2/1973 | France . |
| 270799 | 11/1987 | Japan . |
| 14890 | 1/1988 | Japan . |
| 195296 | 8/1988 | Japan . |

OTHER PUBLICATIONS

Chemical Abstracts 101: 119424k.

*Primary Examiner*—T. M. Tufariello

*Attorney, Agent, or Firm*—Wenderoth, Lind & Ponack

[57] ABSTRACT

Disclosed are electro-plated steel sheets having a primer coating composed of 5 to 30% by weight of Cr, 0.005 to 5% by weight of cation polymer, with the balance being Zn, with or without a further Zn or Zn-alloy coating formed on the primer coating. The primer coating may contain fine particles of oxides and/or iron-group metals, and may further be applied with a chromate film and/or an organic coating. Also disclosed is the process for producing an electro-plated steel sheet having excellent corrosion resistance and surface brightness, comprising performing electro-plating in an acidic Zn plating bath containing Cr ions and cation polymer, with the ratio of $Cr^{6+}$ ions/$Cr^{3+}$ ions being not more than 0.1.

12 Claims, 1 Drawing Sheet

COATED STEEL SHEETS AND PROCESS FOR PRODUCING THE SAME

This application is a continuation-in-part of Ser. No. 07/642,541 filed Jan. 29, 1991, now allowed, which is a continuation of Ser. No. 07/350,032 filed May 10, 1989, now abandoned.

BACKGROUND OF THE INVENTION

1. Field of the Invention

The present invention relates to coated steel sheets or strips (herein called steel sheets) having a coating which can provide excellent corrosion resistance, particularly corrosion resistance in their worked portions, and useful for applications in automobiles, home electric appliances, and construction.

2. Description of Related Arts

Galvanized steel sheets have long been used widely as a surface treated steel sheet, because they can be commercially produced on a mass-production scale without sacrificing their corrosion resistance before or after paint coating and workability as well as strength inherent to cold rolled steel sheets.

In more recent years, trials have been made using galvanized steel sheets as rust preventive steel sheets in automobiles, particularly in cold regions, for preventing rust caused by salt dispersed on highway roads to prevent freezing of the roads. The trend is, however, that more and more demands are being made for satisfactory corrosion resistance of the galvanized steel sheets under severe corrosive environments.

As the means for meeting with the demand for improved corrosion resistance of the galvanized steel sheets, it has been known and commonly practiced to increase the amount of the zinc coating itself and in addition to the increased zinc coating amount, many various proposals have been made for alloy coatings as a means of inhibiting the dissolution of the zinc coating itself. Most of these proposed alloy coatings contain iron-group metals such as Fe, Ni and Co as the alloying element.

The steel sheets electro-plated with a zinc iron-group-metal coating as disclosed in Japanese Patent Publications 50-29821 and 57-61831, for example, are characterized by their excellent corrosion resistance before and after paint coating and have been successful in commercial production and application. However, a strong demand still exists for further improvement of their corrosion resistance.

Further, steel sheets coated with a zinc or zinc alloy coating containing chromium have been proposed as disclosed in Japanese Patent Publications 59-38313 and 59-40234. and Japanese Laid-Open Patent Applications 61-130498, 61-270398 and 62-54099.

All of these proposed chromium-containing coatings contain a very small amount of chromium, which produces only an auxiliary effect on corrosion resistance. Therefore, for the purpose of definitely improving the corrosion resistance, it has long been desired to precipitate a larger amount of chromium in the coating.

For applications in automobiles and home electric appliances, severer demands are being made for improved surface appearance in addition to corrosion resistance, and to meet with the demands, an appropriate treatment for the surface brightening of coatings is strongly desired.

Up to now, no successful art is known for increasing the chromium content in the zinc coating and no successful art is known for producing Zn-Cr coatings with a high-chromium content and yet excellent in the surface appearance.

Thus it is impossible to obtain a satisfactory coating having good surface brightness and workability merely by increasing the $Cr^{3+}$ ion concentration in the plating bath. The increased chromium ion concentration causes various hindrances in operation, such as a sharp lowering in the current efficiency, which prohibit a commercial production of steel sheets having a high-chromium alloy coating.

Meanwhile, to meet with the demands for improved corrosion resistance for applications in automobiles, in particular, a complex coated steel sheet has been developed by subjecting the metallic primer coating to a chromating treatment and then applying an organic coating thereon.

In the art of these steel sheets having the complex coating, main considerations have been given to improvements of the paint composition which forms the upper-most organic coating, and inevitably, no full satisfaction has been achieved concerning improvements of corrosion resistance, press formability, spot weldability, etc. For example, a zinc-rich paint coated steel sheet shows inferior press formability and is not satisfactory with respect to corrosion resistance and weldability, and a steel sheet coated with a paint containing electric conductive pigments is not wholly satisfactory despite its improved press formability and weldability. Further, in all types of the organic coated steel sheets mentioned above, the organic coating is applied in a relatively large quantity exceeding 5 $\mu$ in thickness which is rather detrimental to press formability and weldability.

More recently, steel sheets having a metallic-organic complex coating also have been developed in which the organic coating is applied in a relatively small quantity of less than 5 $\mu$ in thickness. For these thin-type organic coatings, trials have been made to improve the corrosion resistance by introducing rust preventive pigments in the organic coatings. For example, Japanese Laid-Open Patent Application 59-162278 discloses an organic coating in which chromium compounds as the rust preventive pigments are added to a water-dispersion type emulsion resin, and Japanese Laid-Open Patent Application 60-50181 discloses an organic coating in which silica is added as the rust preventive pigment. However, these trials have been found unsuccessful in improving the corrosion resistance.

The corrosion resistance of the steel sheets having a metallic-organic complex coating mentioned above is imparted mainly by the organic coating. However, as the thickness of the organic coatings is required to be thinner from the viewpoint of press formability and weldability, improvement of the metallic primer coating itself is required from the viewpoint of corrosion resistance.

More specifically, as the metallic primer coating, Zn coating, Zn Ni coating, Zn-Fe coating and the like are applied, and in the thin-type organic coatings, the organic coating is further thinned when subjected to the press forming and slight damage or scratches can easily penetrate the thinned organic coating to reach the metallic primer coating or even to the substrate steel sheet, thus causing local exposure of the metallic coating of the substrate sheet. Therefore, the corrosion resistance of these coated sheets must more and more rely on the corrosion resistance of the metallic primer coating alone. However, the conventional metallic coatings cannot impart satisfactory corrosion resistance, and are not reliable for maintaining good corrosion resistance after press forming.

SUMMARY OF THE INVENTION

Therefore the present invention provides a coated steel sheet free from the problems of the prior arts, excellent in corrosion resistance, particularly corrosion resistance after press forming, and further excellent in workability, weldability and surface brightness.

The present invention is based on the discovery that it is possible to achieve a markedly enhanced chromium content in the alloy coating, which has never been conventionally achieved, if a water soluble cation polymer is added to a plating bath containing $Zn^{2+}$ and $Cr^{3+}$ which promotes the precipitation of Cr, and that the resultant coating has satisfactory workability due to the co-precipitation of a very small amount of the cation polymer in the coating.

Further, the present invention is based on the discovery that addition of iron-group metal or metals, Fe, Ni and Co, to the coating will improve the spot weldability as required for the applications in automobiles and home electric appliances.

Still further, the present invention is based on the discovery made by further studies by the present inventors that chromium when present with zinc will not be passivated, but tends to take part in a sacrificial rust prevention together with zinc, and the corrosion product of chromium accumulates and forms a hard-to-dissolve protective film, thereby preventing a further progress of corrosion. This phenomenon is considered to provide a high degree of corrosion resistance.

However, under an exposing condition similar to the actual condition of service, the hard-to-dissolve protective film formed by the corrosion product of chromium is very likely to be cracked due to a long time of drying. Therefore, after the lapse of a certain period of time, corrosion can sharply progress. It is found by the present inventors that it is effective to co-precipitate fine particles of oxides in the coating for preventing such sharp development of corrosion. The fine particles of oxides intrude into the corrosion products of zinc and chromium to be strongly combined therewith. The corrosion products thus combined with the oxides can still provide good humidity absorbing ability so that the protective film formed with the corrosion products is hardly strained even under the dry condition, resulting in effective prevention of cracking occurring in the protective film.

Thus on the basis of the above discovery, it is possible to further stabilize the protective film formed by the corrosion products of the Zn-Cr alloy coatings by the addition of fine particles of oxides in the coating.

Therefore, a further object of the present invention is to provide a coated steel sheet having a primer Zn-Cr coating, an intermediate chromate film, and an uppermost organic coating, which shows excellent corrosion resistance particularly at worked portions, and excellent workability and weldability as well. For this object the Zn-Cr coating contains fine particles of oxide co-precipitated therewith so as to produce corrosion products which are very effective to protect the substrate sheet in event corrosion should occur locally at paint-coating-defective portions or worked portions.

A still further object of the present invention is to provide a process for consistently producing the coated steel sheets having a high-chromium alloy coating excellent in corrosion resistance and surface brightness. For this object, a water soluble cation polymer is introduced into the Zn-Cr electro-plating bath to promote the precipitation of chromium, and the ratio of $Cr^{6+}$ ions to $Cr^{3+}$ ions in the bath is maintained below a certain constant value by the anodic oxidation of $Cr^{3+}$.

Further, for the object to improve the chemical conversion adaptability of coated steel sheets with Zn-Cr coatings containing 5% or more of Cr, the present invention provides a process for producing a duplex-coated steel sheet having an upper coating with a low Cr content and excellent for chemical conversion treatment.

Hereinbelow the coated steel sheets and the process for producing the same according to the present invention will be summarized.

(1) Electro-plated steel sheets having a primer coating composed of 5 to 30% by weight of Cr, 0.005 to 5% by weight of cation polymer, with the balance being Zn, with or without a further Zn or Zn-alloy coating formed on the primer coating.

(2) Electro-plated steel sheets having a primer coating composed of no less than 5% by weight of Cr, no less than 1% by weight of iron-group metal, with the total amount of Cr and the iron-group metal being not more than 30% by weight, 0.005 to 5% by weight of cation polymer with the balance being Zn, with or without a further Zn of Zn-alloy coating formed on the primer coating.

(3) Electro-plated steel sheets having a primer coating composed of 5 to 30% by weight of Cr, 0.1 to 10% by weight of fine particles of oxide, and 0.005 to 5% by weight of cation polymer with the balance being Zn.

(4) Electro-plated steel sheets having a primer coating composed of 5 to 30% by weight of Cr, 0.1 to 10% by weight of fine particles of oxide, 0.005 to 5% by weight of cation polymer, and 1 to 10% by weight of iron group metal with the balance being Zn.

(5) Electro-plated steel sheets according to (3) or (4) which further comprise a Zn or Zn-alloy coating formed on the primer coating.

(6) Coated steel sheets having a primer coating composed of 5 to 30% by weight of Cr, 0.1 to 10% by weight of fine particles of oxide, 0.005 to 5 % by weight of cation polymer, with the balance being Zn, a chromate film formed on the primer coating in an amount of 10 to 150 $mg/m^2$ in total chromium, and an organic coating formed on the chromate film in a thickness of 0.3 to 3 $\mu$.

(7) Electro-plated steel sheets according to (6), in which the primer coating further contains 1 to 10% by weight of an iron-group metal.

(8) Electro-plated steel sheets having a primer coating composed of 5 to 30% by weight of Cr, 0.005 to 5% by weight of cation polymer, with the balance being Zn, a chromate film formed on the primer coating in an amount of 10 to 150 $mg/m^2$ in total chromium, and an organic coating formed on the chromate film in a thickness of 0.3 to 3 $\mu$.

(9) Electro-plated steel sheets having a primer coating composed of Cr and an iron-group metal in a total amount not more than 30% by weight, with Cr being in an amount not less than 5% by weight, and the iron-group metal being in a range from 1/10 to ½ of the Cr content, 0.005 to 5% by weight of cation polymer, with the balance being Zn, a chromate film formed on the primer coating in an amount of 10 to 150 mg/m$^2$ in total chromium, and an organic coating formed on the chromate film in a thickness of 0.3 to 3 $\mu$.

(10) Electro-plated steel sheets according to any of (1) to (9) in which the cation polymer is a quaternary amine polymer.

The process for producing the coated steel sheets according to the present invention will be summarized below.

(1) Process for producing an electro-plated steel sheet having excellent corrosion resistance and surface brightness, comprising performing electro-plating in an acidic Zn plating bath containing Cr ions and cation polymer, with the ratio of $Cr^{6+}$ ions/$Cr^{3+}$ ions being not more than 0.1.

(2) Process according to (1), in which the acidic bath contains at least One member selected from the group consisting of $Ni^{2+}$, $Fe^{2+}$ and $Co^{2+}$.

(3) Process according to (1), in which the acidic bath further contains fine particles of oxide.

(4) Process according to any of (1) to (3), in which the cation polymer is a quaternary amine polymer.

(5) Process for producing a coated steel sheet having a primer coating and an upper coating, and having excellent corrosion resistance, comprising: a step of electroplating a steel sheet in a plating bath containing $Zn^{2+}$ ions, $Cr^{3+}$ ions and an organic polymer under a controlled current density so as to differentiate a composition of the primer coating from a composition of the upper coating.

(6) Process according to (5), wherein the primer coating is a complex zinc coating containing 5–30% by weight of Cr, and 0.001 to 5% by weight of the organic polymer, and the upper coating is a complex zinc coating containing 0.01 to less than 5% by weight of Cr and not more than 1% by weight of the organic polymer.

(7) Process according to (5), wherein the plating bath further contains ions of an iron group metal.

(8) Process according to (7), wherein the primer coating is a complex zinc coating containing 5 to 30% by weight of Cr, 1 to 10% by weight of the iron group metal and 0.001 to 5% by weight of the organic polymer, and the upper coating is a complex zinc coating containing 0.001 to less than 5% by weight of Cr, 1 to 10% by weight of the iron group metal, and not more than 1% by weight of the organic polymer.

DETAILED DESCRIPTION OF THE INVENTION

The excellent corrosion resistance of the electroplated steel sheets according to the present invention is imparted mainly by the chromium content in the primer coating. For this purpose, 5 to 30% by weight of Cr in the coating is desirable. With the Cr content less than 5% by weight in the coating, the tendency of red rust formation is still present and the resultant corrosion resistance is not sufficient, although some improvement is obtained. With the Cr content not less than 5%, the red rust formation during a salt spray test, for example, can be inhibited and marked improvement can be obtained.

The high degree of corrosion resistance imparted by the coated steel sheets according to the present invention has never been achieved by the conventional Zn coating, or Zn-alloy coatings, such as Zn-Fe and Zn-Ni coatings.

As mentioned hereinbefore, Cr when co-present with Zn, is not passivated, but takes part in the sacrificial rust prevention together with Zn, and moreover the corrosion product of Cr precipitates and accumulates as hard-to-dissolve protective film at corroded portions, thus prohibiting the progress of corrosion,and high corrosion resistance is assured.

With the Cr content more than 30% by weight, on the other hand, although the resultant corrosion resistance is satisfactory, the problem of so-called powdering wherein the coating strips off during the working such as press forming cannot be prevented despite the advantageous effect by the co-precipitation of the cation polymer as hereinafter described, and therefore such a high chromium content is not practically applied.

For satisfying both the corrosion resistance and the workability, 5 to 20% by weight of Cr content is more desirable.

The cation polymer used in the present invention has been discovered to be effective to promote the precipitation of Cr during the electro-plating and also co-precipitates with Cr in the coating in a very small amount, thus improving the anti-powdering property. This advantageous effect by the co-precipitation of the cation polymer is assumed to derive from the fact that the co-precipitation prevents the Cr ions from hindering a uniform electro-deposition and growth of Zn and iron-group metals so that a uniform and smoothly coated structure is assured. Thus with the co-precipitation of the cation polymer in the coating, it is possible to obtain a dense coating in which Zn and Cr or Zn, Cr and the iron-group metals are uniformly mixed or alloyed. For this purpose, 0.005 to 5% by weight of cation polymer contained in the coating is desirable. Less than 0.005%, no tangible effect is obtained for improving the anti-powdering property. On the other hand, the cation polymer content more 5% in the coating is difficult to obtain even if the cation polymer concentration in the plating bath is increased, and an excessive cation polymer content in the coating tends to lower the coating adhesion. From the viewpoint of working alone, it is enough if the cation polymer is co-precipitated in the coating in an amount not less than 1/1000 of the Cr content in the coating.

Among the water soluble cation polymers used in the present invention, polymers of quaternary amine having a molecular weight from $10^3$ to $10^6$ are more desirable. Among the amine polymers shown hereinbelow, polyaminesulfone(hereinafter called PAS) and polyamine (hereinafter called PA) are most effective to promote the precipitation of Cr. This is attributable to the adsorption effect by the amine group and the combination of the sulfo group with the metal ions or with the metal.

Basically, the cation polymer used in the present invention is selected from a homopolymer or copolymer having in its main chain a salt of quaternary amine (ammonium salt) shown below.

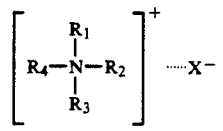

where $R_1$, $R_2$, $R_3$ and $R_4$ are each an alkyl group having 1 to 4 carbon atoms.

Some typical examples of the cation polymers used in the present invention will be illustrated below.

(1) Polymers obtained from diallylamine:

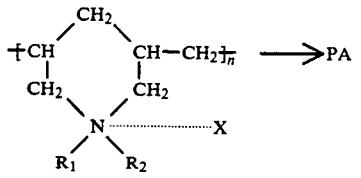

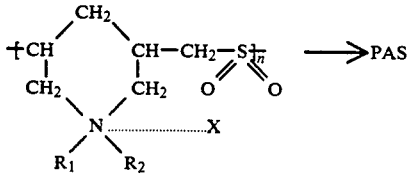

wherein $R_1$ and $R_2$ are each a lower alkyl group ($CH_3$, $C_2H_5$, $C_3H_7$, and $C_4H_9$), and X stands for $Cl^-$, $HSO_4^-$, $H_2PO_4^-$, $R-SO_3^-$ (R is an alkyl having 1 to 4 carbon atoms) and anion of $NO_3^-$.

(2) Polymers obtained from vinylbenzyl.

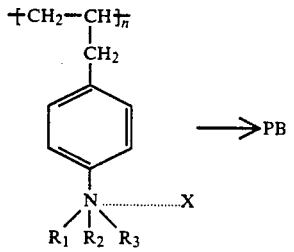

(3) Allylaminepolymers

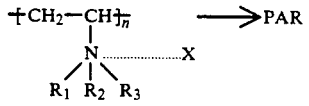

wherein $R_1$, $R_2$ and $R_3$ are each an alkyl group ($CH_3$, $C_2H_5$, $C_3H_7$, or $C_4H_9$) and X represents anions of $Cl^-$, $HSO_4^-$, $H_2PO_4^-$, $R-SO_3^-$ (R is an alkyl group having 1 to 4 carbon atoms) or $NO_3^-$.

In addition to the above quaternary amine polymers, polymers of primary, secondary and tertiary amines may also be used for promoting the precipitation of Cr although they are less effective.

Regarding the amount of the primer coating, 10 to 50 $g/m^2$ is enough for assuring the desired corrosion resistance, and unavoidable impurities such as Pb, Sn, Ag, In, Bi, Cu, Sb, As, Al, Ti, Na, P and S may be present in a minor amount in the primer coating without degrading the desired properties of the present coated products.

For improving the spot weldability of the coated steel sheets according to the present invention, the ion-group metal, such as Fe, Ni and Co, is co-precipitated in the primer coating in an amount of 1 to 10% by weight. The Zn-Cr electro-plated coating containing no iron-group metal shows inferior spot weldability as compared with the conventional Zn-Ni and Zn-Fe alloy coatings. Although not theoretically clarified, the reason for the inferior spot weldability may be attributed to the following fact that as compared with the conventional Zn-Ni and Zn Fe coatings the Zn-Cr coating containing no iron-group metal has a lower electric resistance and is more easily heated and fused by the current passage-,and further the coating itself is softer and is easily deformed by the pressure exerted thereon by a welding tip so that the current can hardly be concentrated on the welding spot.

When the Zn-Cr coating contains the iron-group metal, such as Fe, Ni and Co, the electric resistance is enhanced and the coating itself is hardened so that the spot weldability is definitely improved. An iron-group metal content in an amount less than 1% by weight is not effective for this purpose while in excess of 10% by weight, the coating is influenced largely by the nature of the iron-group metal so that corrosion resistance is, in some cases, deteriorated.

When the iron-group metal is present in the electroplating bath, it produces the favorable effect that ions of this metal adsorb on the fine particles of oxide, if present, to facilitate the precipitation of the oxide. However if the total amount of the iron-group metal in the coating is excessively increased, the workability of the coating is deteriorated despite the favorable effect of the co-precipitation of the cation polymer. Therefore, it is desirable to maintain the total content of Cr and the iron-group metal in the coating at not more than 30% by weight. As the iron-group metal, Ni is most desirable because it can further improve the corrosion resistance of the coating.

The fine particles of oxide contained in the coating contribute to further stabilize the corrosion products of Zn-Cr by intrusion thereinto and strong combination therewith through oxygen bonding, and the fine particles of oxide act as a barrier against corrosive factors. In this way the corrosion resistance of the coated steel sheet, particularly the corrosion resistance at and around the worked portions, is improved.

For the above purpose, it is desirable that the fine particles of oxide are contained in the coating in an amount from 0.1 to 10% by weight. Less than 0.1%, no substantial improvement of corrosion resistance is obtained,and more than 10%, workability is deteriorated. From aspects of both corrosion resistance and workability, 0.1 to 5% by weight of the fine particles of oxide is more preferable.

As the fine particles of oxide usable in the present invention, many metal oxides and semi-metal oxides may be used, but oxides of Si, Al, Zr,Ti, Cr, Mo and W are most preferable. These oxides can be used singly or in combination. The particle size of these oxides is preferably not larger than 1 μm in average. The particle size larger than 1 μm is hard to co-precipitate in the coating.

The primer coating according to the present invention may be of homogeneous or heterogeneous structure. Thus within the scope of the coating composition as defined hereinabove, one or more specific components may be dispersed or condensed in a layer form, or the concentration of specific component or components may vary in gradient across the coating thickness.

The coated steel sheets having the primer coating described hereinabove may further be coated with a Zn or Zn-alloy coating such as Zn-Fe and Zn-Ni coatings in a small amount.

Further, instead of the Zn or Zn-alloy coating, the primer coating may be subjected to a chromate treatment and then further coated with an organic coating.

When the Zn or Zn-alloy coating is applied on the primer coating, 1 to 5 g/m$^2$ of such coating is preferred to improve the corrosion resistance after paint coating under a wet environment as under a salt spray test condition.

The chromate film applied on the primer coating is effective to enhance the adhesion with the organic coating.

As the Zn-Cr coating is highly reactive with an acidic treating solution containing Cr and/or $Cr^{6+}$ and/or $Cr^{3+}$, any of the conventional chromate treatments, such as the spray type chromate treatment, the reaction type chromate treatment, and the electrolytic type chromate treatment may be applied.

For the spray type chromate treatment, and the reaction type chromate treatment, inorganic colloids, acids such as phosphoric acid, fluoride, water-soluble or emulsion type organic resin may be added to the treating solution in addition to $Cr^{6+}$ and $Cr^{3+}$ as conventionally done.

For example, as the solution containing the phosphoric acid and the fluoride, the solution may be composed of 30 g/l of chromic acid, 10 g/l of phosphoric acid, 4 g/l of potassium titanate fluoride, and 0.5 g/l sodium fluoride. As the treating solution containing the silica, the solution may be composed of 50 g/l of chromic acid (including 40% of trivalent chromium) and 100 g/l of $SiO_2$.

As the inorganic colloids, preferred examples are colloids of $SiO_2$, $Al_2O_3$, $TiO_2$ and ZrO; colloids containing one or more of oxyacids such as molybdic acid, tungstic acid, vanadic acid, and their salts; phosphoric acids such as phosphoric acid and polyphosphoric acid which form hard-to-dissolve salts by reaction with Zn of the coating; and silicofluorides titanium, and phosphates which form hard-to-dissolve salts by reaction such as hydrolysis.

These colloids are found to be effective to fix a small amount of hexavalent chromium in the chromate film and also phosphoric acids and fluorides mentioned above in particular are found to be effective to promote the reaction between the primer coating and the chromate.

The amount of these inorganic colloids to be added may vary depending on their natures; in the case of phosphoric acids, 1 to 200 g/l is desirable, and in the case of $SiO_2$, to 800 g/l is desirable, for example.

In some cases, organic resins, such as acrylic resin, which are consistently mixable with the chromate may be added.

As the electrolytic chromate treatment, any conventional treatment can be applied, such as one in which sulfuric acid, phosphoric acid, and halogen ions are added in addition to chromic acid, or inorganic colloids such as $SiO_2$ and $AL_2O_3$ are added, or cations such as Co and Mg are added. Normally the electrolysis is performed by cathodic electrolysis, but anodic electrolysis and alternate current electrolysis may be additionally used.

The amount of chromate film formed on the primer coating is preferably from 10 to 150 mg/m$^2$ in the terms of total chromium. With a chromate film less than 10 mg/m$^2$, the adhesion of the organic film is not satisfactory, while a chromate film more than 150 mg/m$^2$, the weldability and press formability deteriorate. Therefore, from the practical point, 20 to 100 mg/m$^2$ is more desirable.

In order to avoid the contamination of the chemical conversion treating solution with chromium dissolving from the chromate film, and the complicated handling of the waste liquid, it is advantageous to form a chromate film which contains not more than 5% of water-soluble component. For forming this hard-to-dissolve chromate film, the electrolytic chromate treatment is better suited.

On the chromate film, an organic coating of 0.3 to 3 $\mu$ in thickness may be applied for improving the corrosion resistance. With an organic coating less than 0.3 $\mu$ the desired improvement of corrosion resistance cannot be assured, and with an organic coating exceeding 3 $\mu$, weldability and press formability may sometimes deteriorate. A more preferable range is from 0.5 to 2 $\mu$.

The organic coating may be either a solvent type or a water soluble type, and epoxy and acrylic resins, polyester, urethane and acrylic olefins etc., and their copolymer derivatives may be used, for example.

For heat-curing type organic coatings containing rust preventive pigments such as $SiO_2$ and $BaCrO_4$, various additives such as curing agent and lubricant for further improving the press formability may be added.

One preferred embodiment of the organic coating usable in the present invention is illustrated below.

Main resin: bisphenol type epoxy resin (average molecular weight: 300 to 100,000), 30% or more by weight in the coating.

Curing Agent: block polyisocyanate compound: 1/10 to 20/10 by weight ratio to the main resin.

Rust preventive: dry silica (average primary pigment particle size 1 to 100 $\mu$m); 5 to 50% by weight to the coating.

Lubricant: polyethylene wax; 0.1 to 10% by weight to the coating.

Solvent: ketone

The organic coating may be applied by any conventional methods, such as roll coating, spray coating, and curtain flow coating.

According to the present invention, the coated steel sheet may be coated on only one side, and the other side may be uncoated or coated with the Zn-Cr coating alone depending on the final applications the coated steel sheet is intended for.

For producing the coated steel sheet according to the present invention, the electo-plating may be performed in a plating bath containing $Zn^{2+}$ ions, $Cr^{3+}$ ions, and 0.01 to 20 g/l of water soluble cation polymer, such as copolymers of tertiary amines as mentioned hereinbefore, having a pH value ranging from 0.5 to 3 at a bath temperature ranging from 40° to 70° C. with a current density of 20 A/dm$^2$ or higher.

As the case requires, the iron-group metals, and fine particle oxides, such as $SiO_2$, $TiO_2$ and $Al_2O_3$ are added to the bath. Further the addition of salts of $Na^+$, $K^+$, and $NH_4^+$ ions are advantageous for improving the electric conductivity of the bath.

The Zn coating or Zn-alloy coating to be formed on the primer coating may be done by a conventional plating method. In this case, however, it is most desirable to completely remove the dragout containing Cr ions and cation polymer taken out from the primer coating bath with water prior to the coating.

As the upper coating, when a zinc coating or a zinc alloy coating containing no Cr is applied, some improvements in the chemical conversion adaptability and the after-paint properties may be obtained. However a separate plating equipment solely for the upper coating is required and complicated operation is required.

In order to avoid such difficulties the present inventors have discovered a method in which an upper coating containing not more than 5% of Cr excellent for the chemical conversion treatment can be applied by using the same plating bath in which the primer coating is made.

According to the discovery of the present inventors, as the Cr content in the coating tends to increase as the current density increases, it is possible to provide primer and upper coatings different in Cr contents in the same plating bath merely by controlling the current density.

As the co-relation between the current density varies depending on the bath composition, pH and temperature, the primer coating may be electroplated at a higher current density than the reference current density which gives a coating containing 5% of Cr and the upper coating may be electroplated at a current density lower than the reference current density. Thus a preferable range for the current density for electroplating the upper coating containing 5% or less of Cr is about 30 to 50 A/dm$^2$ and a preferable deposition amount is 0.5 to 5 g/m$^2$.

As for the substrate for the coated steel sheet according to the present invention, a dull-finished rolled soft steel sheet is normally used. However, a bright-finished rolled steel sheet may be used, and the steel composition may be a high tensile steel containing larger amounts of Mn, S and P or may be a corrosion resistant steel containing larger amounts of Cr, Cu, Ni and P.

DETAILED DESCRIPTION OF THE PREFERRED EMBODIMENTS

Figure 1:
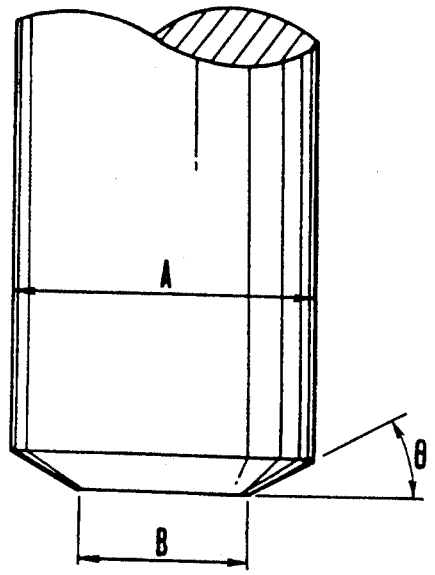
FIG. 1 is a drawing showing the shape of welding tip used for evaluating the spot-weldability.

The present invention will be described in more detail in connection with the embodiments.

EXAMPLE 1

A cold rolled steel sheet with a thickness of 0.8 mm was subjected to alkali degreasing, acid pickling with the use of 5% sulfuric acid solution and washing in succession, and then the resultant steel sheet was electro-plated in an acidic bath of sulfuric acid at pH 2 at a bath temperature of 60° C., with a flow rate of the solution of 90 m/min by pump stirring, and the distance between the electrodes of 10 mm. The plating bath was composed of 70 g/l of $Zn^{2+}$ ion, 1-30 g/l of $Cr^{3+}$ ion, 0.01-20 g/l of cationic polymer (polyamine polymer (PA) with molecular weight of 10,000 or polyamine-sulfone polymer (PAS) with molecular weight of 120,000) and 16 g/l of $Na^{+}$. The contents of Cr and cationic polymer were controlled by their addition amounts and the electric current density. The plated amount was 20 g/m$^2$. In certain instances, further, Zn or Zn-alloy coating was applied in an amount of 3 g/m$^2$ as a topcoat by means of a known method.

The coating compositions and evaluation of corrosion resistance and workability of the electro-plated steel sheets produced in this way are shown in Table 1. By the way, Zn and Cr in the coating were analysed by means of the atomic absorption method and, as for the cationic polymer, C was analyzed by the combustion method and the amount of cationic polymer was recalculated therefrom. The methods for the evaluation of corrosion resistance and workability are as follows:

(1) Corrosion resistance of non paint-coated samples (a) Salt spray test (SST) (in accordance with JIS Z2371): Evaluated by the area of red rust formed after 672 hours.

less than 1%: ◎
1%-10%: ○
10%-30%: Δ
more than 30%: X (b) Cyclic corrosion test (CCT):

Salt spray (JIS Z2371) for 4 hours
↓
Drying (60° C.) for 4 hours
↓
Moisture treatment (50° C., RH 95%) for 4 hours By taking the above three steps as one cycle, the results were evaluated by the loss of sheet thickness after 30 cycles.

less than 0.1 mm: ◎
0.1 mm-0.2 mm: ○
0.2 mm-0.3 mm: Δ
more than 0.3 mm: X (2) Corrosion resistance after paint coating The Zn-Cr coated samples were subjected successively to immersion type phosphoric acid treatment, cathodic electric coating of Zn with a thickness of 20 μm, intermediate coating, water polishing and topcoat paint coating to obtain a total thickness of coatings of 100 μm. The test pieces were given a crosscut reaching to the base metal and subjected to the 1,000 hour SST and the 60 cycle CCT as above mentioned, and the results were evaluated by means of the swollen width of the crosscut part.

less than 1 mm: ◎
1 mm-3 mm: ○
3 mm-5 mm: Δ
more than 5 mm: X (3) Workability

After cylindrical press forming with a size of 50ϕ×25 H, tape peeling tests were done on the worked surfaces, and the results were evaluated by the weight losses.

less than 2 mg: ◎
2 mg-5 mg: ○
5 mg-8 mg: Δ
more than 8 mg: X

All the examples of the present invention were obviously excellent both in corrosion resistance and workability as compared with the comparison examples.

TABLE 1

| No. | Primer Coating Composition (weight %) Zn | Cr | Cation Polymer | | Others | Kind of Upper Layer Coating | Corrosion Resistance before Paint Coating SST | CCT | Corrosion Resistance after Paint Coating SST | CCT | Workability |
|---|---|---|---|---|---|---|---|---|---|---|---|
| Example | | | | | | | | | | | |
| 1 | balance | 5 | PA | 0.005 | | | ○ | ○ | ○ | ○ | ○ |
| 2 | " | 10 | " | 0.005 | | | ◎ | ◎ | ○ | ◎ | Δ |
| 3 | " | 20 | " | 1 | | | ◎ | ◎ | ○ | ◎ | ◎ |
| 4 | " | 30 | " | 3 | | | ◎ | ◎ | ○ | ◎ | ○ |
| 5 | " | 5 | PAS | 0.005 | | | ○ | ○ | ○ | ○ | ○ |
| 6 | " | 10 | " | 1 | | | ◎ | ◎ | ○ | ◎ | ◎ |
| 7 | " | 20 | " | 3 | | | ◎ | ◎ | ○ | ◎ | ◎ |
| 8 | " | 30 | " | 5 | | | ◎ | ◎ | ○ | ◎ | ○ |
| 9 | " | 7 | " | 0.01 | | | ◎ | ◎ | ○ | ◎ | ○ |
| 10 | " | 7 | " | 0.1 | | | ◎ | ◎ | ○ | ◎ | ◎ |
| 11 | " | 7 | " | 1 | | | ◎ | ◎ | ○ | ◎ | ◎ |
| 12 | " | 15 | " | 0.05 | | | ◎ | ◎ | ○ | ◎ | ○ |
| 13 | " | 15 | " | 0.5 | | | ◎ | ◎ | ○ | ◎ | ◎ |
| 14 | " | 15 | " | 5 | | | ◎ | ◎ | ○ | ◎ | ◎ |
| 15 | " | 7 | " | 0.01 | | Zn | ◎ | ◎ | ◎ | ◎ | ○ |
| 16 | " | 7 | " | 0.1 | | Zn-11% Ni | ◎ | ◎ | ◎ | ◎ | ◎ |
| 17 | " | 7 | " | 1 | | Zn-80% Fe | ◎ | ◎ | ◎ | ◎ | ◎ |
| 18 | " | 15 | " | 0.05 | | Zn | ◎ | ◎ | ◎ | ◎ | ○ |
| 19 | " | 15 | " | 0.5 | | Zn-11% Ni | ◎ | ◎ | ◎ | ◎ | ◎ |
| 20 | " | 15 | " | 5 | | Zn-80% Fe | ◎ | ◎ | ◎ | ◎ | ◎ |
| Comparison | | | | | | | | | | | |
| 21 | 100 | — | — | — | | | x | x | x | x | ○ |
| 22 | balance | — | — | — | Ni, 12 | | x | x | Δ | Δ | ◎ |
| 23 | " | — | — | — | Fe, 15 | Zn-80% Fe | x | x | Δ | Δ | ◎ |
| 24 | " | 5 | — | — | | | ○ | ○ | ○ | ○ | x |
| 25 | " | 1 | PAS | 0.03 | | | Δ | x | Δ | x | ○ |
| 26 | " | 40 | PAS | 0.5 | | | ◎ | ◎ | ○ | ◎ | x |
| 27 | " | 10 | PAS | 0.001 | | | ◎ | ◎ | ○ | ◎ | x |

EXAMPLE 2

Except the addition of 10–150 g/l of iron group metal ion to the plating bath composition, plating was done under the same conditions as in Example 1.

The coating compositions and evaluation of corrosion resistance, spot weldability and workability of the electro-plated steel sheets produced in this way are shown in Table 2. Zn, Cr, Fe, Co and Ni in the coating were analyzed by means of the atomic absorption method and, for the cationic polymer, the amount of carbon was analyzed by the combustion method and the amount of cationic polymer was recalculated therefrom. The methods for evaluating corrosion resistance and workability were the same as in Example 1. Spot weldability was evaluated by the following method.

Spot Weldability:

The welding conditions were as below.

| | |
|---|---|
| Electric current: | 8 kA |
| Number of cycle: | 10 cycles |
| Pressure applied: | 200 kg |
| Shape of welding tip: | as shown in FIG. 1 (where A is 12 mmϕ, B is 6 mmϕ and θ is 30°) |

After continuous shock of 5,000 times, the nugget diameter was measured and the results were evaluated as follows.

| | |
|---|---|
| not less than 3.6 mm: | ○ |
| less than 3.6 mm: | X |

TABLE 2

| No. | Primer Coating Composition (weight %) Zn | Cr | Iron-group Metal | Cation Polymer | | Kind of Upper Layer Coating | Corrosion Resistance before Paint Coating SST | Corrosion Resistance after Paint Coating SST | CCT | Workability | Spot Workability |
|---|---|---|---|---|---|---|---|---|---|---|---|
| Example 2 | | | | | | | | | | | |
| 2-1 | balance | 5 | Ni:3 | PA | 0.01 | | ◎ | ○ | ◎ | ○ | ◎ |
| 2-2 | " | 5 | Ni:3 | " | 0.1 | | ◎ | ○ | ◎ | ○ | ◎ |
| 2-3 | " | 5 | Fe:3 | " | 0.01 | | ○ | ○ | ○ | ○ | ○ |
| 2-4 | " | 5 | Co:3 | " | 0.01 | | ○ | ○ | ○ | ○ | ○ |
| 2-5 | " | 7 | Ni:10 Co:1 | PAS | 0.01 | | ◎ | ○ | ◎ | ○ | ◎ |
| 2-6 | " | 15 | Ni:5 | " | 0.01 | | ◎ | ○ | ◎ | ○ | Δ |
| 2-7 | " | 25 | Ni:3 | " | 3 | | ◎ | ○ | ◎ | ○ | ○ |
| 2-8 | " | 29 | Ni:1 | " | 5 | | ◎ | ○ | ◎ | ○ | ○ |
| 2-9 | " | 5 | Ni:1 | " | 0.005 | | ○ | ○ | ○ | ○ | ○ |
| 2-10 | " | 5 | Ni:2 | " | 0.05 | | ◎ | ○ | ◎ | ○ | ◎ |
| 2-11 | " | 5 | Ni:5 | " | 0.5 | | ◎ | ○ | ◎ | ○ | ◎ |
| 2-12 | " | 10 | Ni:1 | " | 0.01 | | ◎ | ○ | ◎ | ○ | ◎ |
| 2-13 | " | 10 | Ni:5 | " | 0.1 | | ◎ | ○ | ◎ | ○ | ◎ |

TABLE 2-continued

| No. | Primer Coating Composition (weight %) Zn | Cr | Iron-group Metal | Cation Polymer | | Kind of Upper Layer Coating | Corrosion Resistance before Paint Coating SST | Corrosion Resistance after Paint Coating SST | CCT | Spot Workability | Spot Workability |
|---|---|---|---|---|---|---|---|---|---|---|---|
| 2-14 | " | 10 | Ni:10 | " | 1 | | ◎ | ○ | ◎ | ○ | ◎ |
| 2-15 | " | 5 | Ni:1 | " | 0.005 | Zn | ○ | ◎ | ○ | ○ | ○ |
| 2-16 | " | 5 | Ni:2 | " | 0.05 | Zn-11% Ni | ◎ | ◎ | ◎ | ○ | ◎ |
| 2-17 | " | 5 | Ni:5 | " | 0.5 | Zn-80% Fe | ◎ | ◎ | ◎ | ○ | ◎ |
| 2-18 | " | 10 | Ni:1 | " | 0.01 | Zn | ◎ | ◎ | ◎ | ○ | ◎ |
| 2-19 | " | 10 | Ni:5 | " | 0.1 | Zn-11% Ni | ◎ | ◎ | ◎ | ○ | ◎ |
| 2-20 | " | 10 | Ni:10 | " | 1 | Zn-80% Fe | ◎ | ◎ | ◎ | ○ | ◎ |
| Comparison 2 | | | | | | | | | | | |
| 2-21 | 100 | — | — | — | — | | x | x | x | x | ○ |
| 2-22 | balance | — | Ni:12 | — | — | | x | Δ | Δ | ○ | ◎ |
| 2-23 | " | — | Ni:15 | — | — | Zn-80% Fe | x | Δ | Δ | ○ | ◎ |
| 2-24 | " | 5 | — | — | — | | ○ | ○ | ○ | x | x |
| 2-25 | " | 1 | Ni:5 | PAS | 0.5 | | Δ | Δ | x | ○ | ○ |
| 2-26 | " | 10 | Ni:0.1 | " | 1 | | ◎ | ○ | ◎ | x | ◎ |
| 2-27 | " | 35 | Ni:5 | " | 3 | | ◎ | ○ | ◎ | ○ | x |
| 2-28 | " | 10 | Ni:5 | " | 0.001 | | ◎ | ○ | ◎ | ○ | x |

EXAMPLE 3

Zn plating+chromate treatment

Except the addition of 0–30 g/l of iron-group metal to the plating bath composition, plating was done under the same conditions as in Example 1. To the plated steel sheets, chromate treatment and organic coating were further applied as shown below.

(1) Chromate treatment (a) Electrolysis-type chromate treatment:

By using a treating solution containing 3.0 g/l of chromic acid and 0.2 g/l of sulfuric acid, the plated steel sheet in the above was subjected to cathodic electrolysis with a current density of 10 A/dm$^2$ at a bath temperature of 40° C., and the resultant product was washed and dried. The amount of chromate to be formed was controlled by means of the amount of coulomb.

(b) Coating-type chromate treatment:

The coated steel sheets were immersed in a treating solution comprising 50 g/l of chromic acid (containing $Cr^{3+}$ 40%), 100 g/l of colloidal $SiO_2$ at a bath temperature of 40° C. The resultant coated steel sheets were dried for 1 min at 100° C. after air-wipe treatment. The amount of chromate to be formed was controlled by means of the dilution ratio of the treating solution and the pressure at the air-wipe treatment.

(c) Reaction-type chromate treatment:

A treating solution containing 50 g/l of chromic acid, 10 g/l of phosphoric acid, 0.5 g/l of NaF and 4 g/l of $K_2TiF_6$ was sprayed on coated steel sheets at a bath temperature of 60° C., and the resultant coated steel sheets were dried at 60° C. after washing. The amount of chromate was controlled by means of the dilution ratio of the treating solution and the duration of its spraying.

(2) Organic coating

The coated steel sheets obtained by the above mentioned chromate treatment were further subjected to organic coating under the following conditions.

While the kind of resin as the main constituent is shown in Table 3, such agents as a rust preventing pigment, for instance $SiO_2$, curing agent, catalyst, lubricant and reformer against wetting were also added in the paint. The coated steel sheets to which chromate treatment was applied were further coated with the paint by means of a roll-coater, baked and dried. The baking condition differed in accordance with the type of resin used, but final sheet temperature was selected in the range of 100°–200° C.

The construction of the thus obtained coated steel sheets having organic coating and the result of evaluation of their corrosion resistance, workability and weldability are shown in Table 3. The methods for evaluation are as below.

(a) Corrosion resistance of non worked portions:

The evaluation was done by the cycle corrosion test (CCT) as specified in Example 1.

(b) Corrosion resistance of worked portions:

After cylindrical press forming with a size of 50 mmϕ×25 mmH, the salt spray test (JIS Z2371) was done for 2,000 hours, and the evaluation was done with respect to the red-rust-suffering area in the worked portions.

| | |
|---|---|
| less than 1%: | ◎ |
| 1%–5%: | ○ |
| 5%–10%: | Δ |
| more than 10%: | X |

(c) Press workability:

Evaluation was done by the workability evaluation method as specified in Example 1.

(d) Spot weldability:

Welding was done under the conditions shown in Example 2, and the evaluation was done by means of the number of times in continuous shock.

| | |
|---|---|
| number of times more than 5,000: | ◎ |
| " 4,000–5,000: | ○ |
| " 3,000–4,000: | Δ |
| " less than 3,000: | X |

The results of these tests are shown in Table 3. As for comparison examples, the Cr content in the primer coating of No. 3-17 is too low, the iron group metal content (Ni) in the primer coating of No. 3-20 is too high, the organic coating film in No. 3-24 is too thin, and the primer coating in No. 3-26 contains no Cr, so that the corrosion resistance of these samples is not good. On the other hand, the Cr content in the primer coating of No. 3-18 is too high, No. 3-19 contains no cationic polymer in the primer coating, No. 3-21 contains an excessive amount of Cr and iron group metal (Ni) in total in the primer coating and No. 3-22 has too small amount of chromate film, and consequently their press workability is inferior and the corrosion resistance is also low. Further, since No. 3-23 has too much amount of chromate film, and No. 3-25 has too much organic coating film, their spot weldability is inferior.

In contrast to these comparison examples, as obvious from Table 3 all examples according to the present invention are excellent in all the points of corrosion resistance, workability and weldability.

TABLE 3

| | Primer Coating Composition (other than Zn) | | | | | Chromate Film | | Organic Film | |
|---|---|---|---|---|---|---|---|---|---|
| | Cr | Iron-group Metal | | Cation Polymer | | | Amount of Cr | | |
| No. | (weight %) | kind | (weight %) | kind | (weight %) | Type | Deposition (mg/m²) | Main Polymer Component | Thickness (μ) |
| Example 3 | | | | | | | | | |
| 3-1 | 5 | — | — | PAS | 0.05 | Electrolysis | 20 | Epoxy | 1.0 |
| 3-2 | 10 | — | — | PA | 0.5 | " | 40 | Acrylic | 1.2 |
| 3-3 | 20 | — | — | PAS | 2 | Reaction | 50 | Urethane | 1.2 |
| 3-4 | 30 | — | — | " | 5 | Spray | 40 | Acrylic-Olefinic | 1.2 |
| 3-5 | 5 | Ni | 2 | " | 0.05 | Electrolysis | 40 | Epoxy | 1.0 |
| 3-6 | 5 | Fe | 2 | PA | 0.1 | Reaction | 80 | Acrylic | 0.7 |
| 3-7 | 5 | Co | 2 | PAS | 1 | Spray | 30 | Urethane | 0.7 |
| 3-8 | 7 | Ni | 3 | " | 0.05 | Electrolysis | 40 | Epoxy | 2.0 |
| 3-9 | 7 | Ni | 2 | " | 0.005 | " | 10 | " | 1.0 |
| | | Fe | 1 | | | | | | |
| 3-10 | 7 | Ni | 2 | PA | 0.2 | " | 150 | " | 1.0 |
| | | Co | 1 | | | | | | |
| 3-11 | 7 | Ni | 1 | PAS | 0.1 | " | 40 | " | 3.0 |
| 3-12 | 10 | Ni | 3 | PAS | 0.01 | " | 50 | " | 0.3 |
| 3-13 | 10 | Fe | 5 | " | 2 | Reaction | 100 | Acrylic-Olefinic | 0.7 |
| 3-14 | 10 | Co | 5 | PA | 0.5 | Spray | 20 | Epoxy | 0.7 |
| 3-15 | 20 | Ni | 2 | PAS | 1 | Electrolysis | 40 | " | 1.5 |
| 3-16 | 20 | Ni | 10 | " | 5 | " | 50 | " | 0.5 |
| Comparison 3 | | | | | | | | | |
| 3-17 | 0.1 | — | — | " | 0.05 | " | 60 | " | 1.0 |
| 3-18 | 35 | — | — | " | 3 | " | 20 | " | 1.0 |
| 3-19 | 5 | — | — | — | — | " | 40 | " | 1.0 |
| 3-20 | 10 | Ni | 10 | PAS | 0.5 | " | 40 | " | 1.0 |
| 3-21 | 30 | Ni | 15 | " | 1 | " | 40 | " | 1.0 |
| 3-22 | 5 | — | — | " | 0.05 | " | 5 | " | 1.0 |
| 3-23 | 5 | — | — | " | 0.05 | " | 200 | " | 1.0 |
| 3-24 | 5 | Ni | 2 | " | 0.05 | " | 40 | " | 0.1 |
| 3-25 | 5 | Ni | 2 | " | 0.05 | " | 40 | " | 3.5 |
| 3-26 | — | Ni | 11 | — | — | " | 40 | " | 1.0 |

| No. | Corrosion Resistance before Working | Corrosion Resistance after Working | Press Formability | Spot Workability |
|---|---|---|---|---|
| Example 3 | | | | |
| 3-1 | ◎ | ○ | ◎ | ○ |
| 3-2 | ◎ | ◎ | ◎ | ○ |
| 3-3 | ◎ | ◎ | ◎ | ○ |
| 3-4 | ◎ | ◎ | ◎ | ○ |
| 3-5 | ◎ | ◎ | ◎ | ◎ |
| 3-6 | ◎ | ○ | ◎ | ◎ |
| 3-7 | ◎ | ○ | ◎ | ◎ |
| 3-8 | ◎ | ◎ | ◎ | ◎ |
| 3-9 | ◎ | ◎ | ◎ | ◎ |
| 3-10 | ◎ | ◎ | ○ | ○ |
| 3-11 | ◎ | ◎ | ○ | ○ |
| 3-12 | ○ | ○ | ◎ | ◎ |
| 3-13 | ◎ | ◎ | ◎ | ◎ |
| 3-14 | ◎ | ◎ | ◎ | ◎ |
| 3-15 | ◎ | ◎ | ◎ | ◎ |
| 3-16 | ◎ | ◎ | ◎ | ◎ |
| Comparison 3 | | | | |
| 3-17 | x | x | ○ | ○ |
| 3-18 | ◎ | Δ | x | ○ |
| 3-19 | ◎ | Δ | x | ○ |
| 3-20 | Δ | Δ | ◎ | ◎ |
| 3-21 | ◎ | Δ | x | ◎ |
| 3-22 | ○ | Δ | x | ○ |
| 3-23 | ◎ | ○ | Δ | x |
| 3-24 | x | x | ◎ | ◎ |
| 3-25 | ◎ | ◎ | x | x |
| 3-26 | Δ | x | ◎ | ◎ |

EXAMPLE 4

Except the addition of 0–50 g/l of iron group metal ion and 10–100 g/l of fine oxide particles ($SiO_2$, $Al_2O_3$, $ZrO_2$ and $TiO_2$ having a mean particle size of 0.02–0.05 μ, and $Cr_2O_3$ and $WO_3$ having a mean particle size of 0.1–0.5 μ in the plating bath composition, plating was done under the same conditions as in Example 1.

The compositions of primer coatings and results of evaluation are as shown in Table 4. By the way, the methods for determining metal constituents as well as the cationic polymers used are same as in Examples 1 and 2. The methods for evaluating corrosion resistance and workability are as below.

(1) Corrosion resistance of nonpaint-coated sample

Salt spray test (exposed at Chiba district by spraying 5% saline water once a week) was done, and the results were evaluated by the area where red rust formed after one year exposure.

| | |
|---|---|
| less than 1%: | ◎ |
| 1%–10%: | ○ |
| 10%–30%: | Δ |
| more than 30%: | X |

(2) Corrosion resistance after paint coating

The result was evaluated according to the method as specified in Example 1.

(3) Spot weldability

The welding was done under the conditions as shown in Example 2, and the results were evaluated according to the following method, i.e., to measure the diameter of nugget after continuous shock of 3,000 times.

| | |
|---|---|
| more than 4 mm: | ◎ |
| 3 mm–4 mm: | ○ |
| less than 3 mm: | X |

(4) Workability

Evaluated according to the method as specified in Example 1.

The results are shown in Table 4. All the examples according to the present invention are excellent in corrosion resistance and weldability as compared with the comparison examples. The examples containing iron group metal are particularly excellent in their spot weldability, and the examples having topcoat coating are also particularly excellent in the corrosion resistance after paint coating.

TABLE 4

| | Primer Coating Composition (weight %) | | | | | | | | | | | | | |
|---|---|---|---|---|---|---|---|---|---|---|---|---|---|---|
| No. | Zn | Cr | iron-group Metal | | Fine Particle Oxide | | Cation Polymer | | Kind of Upper Layer Coating | Corrosion Resistance before Paint Coating Exposure | Corrosion Resistance after Paint Coating SST | Corrosion Resistance after Paint Coating Exposure | Spot Work-ability | Work-ability |
| Example 4 | | | | | | | | | | | | | | |
| 4-1 | balance | 5 | — | — | $SiO_2$ | 2 | PA | 0.1 | | ◎ | ○ | ○ | ○ | ◎ |
| 4-2 | " | 10 | — | — | $TiO_2$ | 2 | " | 0.5 | | ◎ | ○ | ◎ | ○ | ◎ |
| 4-3 | " | 20 | — | — | $ZrO_2$ | 2 | " | 1 | | ◎ | ○ | ◎ | ○ | ◎ |
| 4-4 | " | 29 | — | — | $Al_2O_3$ | PAS | 5 | | ◎ | ○ | ◎ | ○ | ○ | |
| 4-5 | " | 5 | — | — | $SiO_2$ $Al_2O_3$ | 1 | " | 0.5 | | ◎ | ○ | ○ | ○ | ◎ |
| 4-6 | " | 10 | — | — | $SiO_2$ | 0.1 | " | 0.5 | | ◎ | ○ | ◎ | ○ | ◎ |
| 4-7 | " | 15 | — | — | " | 5 | " | 1 | | ◎ | ○ | ◎ | ○ | ◎ |
| 4-8 | " | 5 | — | — | " | 10 | " | 0.01 | | ◎ | ○ | ○ | ○ | ○ |
| 4-9 | " | 15 | — | — | " | 0.1 | " | 2 | Zn | ◎ | ◎ | ◎ | ○ | ◎ |
| 4-10 | " | 5 | — | — | " | 1 | " | 0.05 | Zn-12% Ni | ◎ | ◎ | ◎ | ○ | ◎ |
| 4-11 | " | 10 | — | — | " | 3 | " | 0.1 | Zn-85% Fe | ○ | ◎ | ◎ | ○ | ◎ |
| 4-12 | " | 5 | Ni | 10 | $SiO_2$ | 3 | PA | 0.1 | | ◎ | ○ | ◎ | ◎ | ○ |
| 4-13 | " | 7 | Ni Fe | 5 1 | $Al_2O_3$ | 3 | " | 0.3 | | ◎ | ○ | ◎ | ◎ | ◎ |
| 4-14 | " | 10 | Ni Co | 5 1 | $ZrO_2$ | 3 | " | 0.5 | | ◎ | ○ | ◎ | ◎ | ◎ |
| 4-15 | " | 20 | Co | 5 | $WO_3$ | 3 | PAS | 3 | | ◎ | ○ | ◎ | ◎ | ○ |
| 4-16 | " | 7 | Ni | 3 | $SiO_2$ | 2 | " | 1 | | ◎ | ○ | ◎ | ◎ | ◎ |
| 4-17 | " | 5 | " | 3 | $SiO_2$ | 0.1 | " | 0.05 | | ◎ | ○ | ◎ | ◎ | ◎ |
| 4-18 | balance | 7 | Ni | 2 | $SiO_2$ | 5 | PAS | 0.05 | | ◎ | ○ | ◎ | ◎ | ◎ |
| 4-19 | " | 10 | " | 4 | " | 10 | " | 0.5 | | ◎ | ○ | ◎ | ◎ | ○ |
| 4-20 | " | 25 | " | 5 | " | 3 | " | 5 | Zn | ◎ | ◎ | ◎ | ◎ | ○ |
| 4-21 | " | 7 | " | 2 | " | 3 | " | 0.3 | Zn-12% Ni | ◎ | ◎ | ◎ | ◎ | ◎ |
| 4-22 | " | 10 | " | 3 | " | 3 | " | 1 | " | ◎ | ◎ | ◎ | ◎ | ◎ |
| 4-23 | " | 5 | " | 10 | " | 3 | " | 0.01 | " | ◎ | ◎ | ◎ | ◎ | ◎ |
| 4-24 | " | 7 | " | 5 | " | 3 | " | 0.1 | " | ◎ | ◎ | ◎ | ◎ | ◎ |
| 4-25 | " | 10 | " | 3 | " | 3 | " | 2 | ZN-85% Fe | ○ | ◎ | ◎ | ◎ | ◎ |
| Comparison 4 | | | | | | | | | | | | | | |
| 4-26 | 100 | — | — | — | — | — | — | — | | x | x | x | x | ○ |
| 4-27 | balance | — | Ni | 15 | — | — | — | — | | x | Δ | Δ | ◎ | ◎ |
| 4-28 | " | 10 | — | — | — | — | PAS | 1 | | Δ | ○ | Δ | ○ | ◎ |
| 4-29 | " | 0.1 | Ni | 3 | $SiO_2$ | 3 | " | 0.01 | | x | x | x | ◎ | ○ |
| 4-30 | " | 35 | — | — | $Al_2O_3$ | 2 | " | 5 | | ◎ | ○ | ◎ | ○ | x |
| 4-31 | " | 5 | Ni | 15 | $ZrO_2$ | 3 | " | 0.1 | | Δ | ○ | ○ | ◎ | x |
| 4-32 | " | 10 | " | 3 | $TiO_2$ | 0.01 | " | 1 | | Δ | ○ | Δ | ○ | ◎ |
| 4-33 | " | 10 | " | 3 | $Cr_2O_3$ | 15 | " | 1 | | ◎ | ○ | ◎ | ◎ | x |
| 4-34 | " | 10 | — | — | $SiO_2$ | 2 | — | — | | ◎ | ○ | ○ | ○ | x |

EXAMPLE 5

Plating was done under the same conditions as in Example 4, and the resultant coated steel sheets were subjected to chromate treatment and organic film coating treatment in succession under the same conditions as in Example 3.

The construction of thus produced composite coated steel sheets having organic film coating and their corrosion resistance, workability and weldability were evaluated as shown in Table 5. The methods for evaluation are as below.

(a) Corrosion resistance of flat sheet:

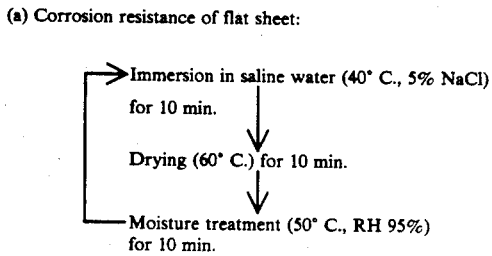

By taking the above three steps as one cycle, the results were evaluated by the loss of sheet thickness after 3,000 cycles.

| |
|---|
| less than 0.1 mm: ◎ |
| 0.1 mm–0.2 mm: ○ |
| 0.2 mm–0.3 mm: Δ |
| more than 0.3 mm: X |

(b) Corrosion resistance of the worked portions:

After cylindrical press forming with a size of 50 mmϕ×25 mmH, the salt spray test (JIS Z2371) was done for 3 000 hours, and the evaluation was done with respect to the red-rust-suffering area at the worked portions.

| |
|---|
| less than 1%: ◎ |
| 1%–5%: ○ |
| 5%–10%: Δ |
| more than 10%: X |

(c) Press workability:

Evaluation was done by the method as specified in Example 1.

(d) Spot weldability:

Welding and evaluation were done similarly as in Example 3.

The results of these tests are shown in Table 5. As for comparison examples, No. 5-20 is low in Cr content in the primer coating, No. 5-22 is too high in the content of iron group metal (Ni) in the primer coating, No. 5-23 and 5-24 contain no fine oxide particles in the primer coating, No. 5-28 is too thin in its organic coating film and No. 5-30 contains no Cr in the primer coating, so that they are all inferior in corrosion resistance. On the other hand, No. 5-21 contains too much Cr in the primer coating, No. 5-25 contains no cationic polymer in the primer coating, and No. 5-26 is too thin in its chromate film, and therefore their press workability, and accordingly, corrosion resistance at the worked portions are inferior. Further, since No. 5-27 has too much chromate film and No. 5-29 is too thick in its organic film, their press workability and spot weldability are not good.

In contrast to these comparison examples, all examples No. 5-1 to 5-19 according to the present invention are superior in corrosion resistance, workability and weldability.

TABLE 5

| | Primer Coating Composition | | | | | | | | Chromate Film | |
|---|---|---|---|---|---|---|---|---|---|---|
| | | Cr | Iron-group Metal | | Fine Particle Oxide | | Cation Polymer | | | Amount of Cr Deposition |
| No. | Zn | (weight %) | kind | (weight %) | kind | (weight %) | kind | (weight %) | Type | (mg/m²) |
| Example 5 | | | | | | | | | | |
| 5-1 | balance | 5 | — | — | $WO_3$ | 2 | PAS | 0.05 | Electrolysis | 40 |
| 5-2 | " | 7 | — | — | $SiO_2$ | 10 | " | 0.1 | " | 60 |
| 5-3 | " | 10 | — | — | " | 5 | PA | 0.5 | " | 80 |
| 5-4 | " | 20 | — | — | " | 0.1 | PAS | 1 | " | 20 |
| 5-5 | " | 30 | — | — | $SiO_2$ | 1 | " | 5 | Spray | 10 |
| | | | | | $TiO_2$ | 1 | | | | |
| 5-6 | " | 5 | Ni | 2 | $SiO_2$ | 2 | " | 0.01 | Electrolysis | 60 |
| 5-7 | " | 5 | Fe | 2 | " | 2 | " | 0.5 | " | 80 |
| 5-8 | " | 5 | Co | 2 | " | 2 | PA | 1 | Spray | 150 |
| 5-9 | " | 7 | Ni | 2 | $WO_3$ | 3 | PAS | 0.05 | Electrolysis | 20 |
| | | | Fe | 1 | | | | | | |
| 5-10 | " | 7 | Ni | 2 | $Cr_2O_3$ | 3 | " | 0.5 | " | 100 |
| | | | Co | 1 | | | | | | |
| 5-11 | " | 7 | Ni | 3 | $SiO_2$ | 10 | " | 0.01 | " | 50 |
| 5-12 | " | 7 | Ni | 5 | " | 5 | " | 1 | " | 50 |
| 5-13 | " | 7 | Ni | 3 | " | 0.1 | PA | 0.1 | " | 50 |
| 5-14 | " | 10 | Ni | 2 | $TiO_2$ | 2 | PAS | 0.01 | " | 150 |
| 5-15 | " | 10 | Fe | 5 | $Al_2O_3$ | 2 | " | 1 | Reaction | 40 |
| 5-16 | " | 10 | Co | 5 | $ZrO_2$ | 2 | " | 2 | Electrolysis | 50 |
| 5-17 | " | 10 | Ni | 5 | $SiO_2$ | 2 | PA | 0.1 | " | 10 |
| 5-18 | " | 20 | Ni | 2 | $SiO_2$ | 1 | PAS | 1 | " | 50 |
| 5-19 | " | 20 | Ni | 10 | " | 2 | " | 5 | Spray | 40 |
| Comparison 5 | | | | | | | | | | |
| 5-20 | balance | 0.1 | — | — | $SiO_2$ | 2 | PA | 0.001 | Electrolysis | 50 |
| 5-21 | " | 35 | — | — | $Al_2O_3$ | 2 | " | 5 | " | 50 |
| 5-22 | " | 5 | Ni | 15 | $ZrO_2$ | 5 | " | 0.5 | " | 50 |
| 5-23 | " | 10 | — | — | — | — | " | 1 | " | 50 |
| 5-24 | " | 7 | Ni | 5 | — | — | " | 0.5 | " | 50 |
| 5-25 | " | 5 | — | — | $TiO_2$ | 2 | — | — | " | 50 |
| 5-26 | " | 5 | Ni | 3 | $SiO_2$ | 3 | PAS | 0.5 | " | <5 |

TABLE 5-continued

| | | | | | | | | | | |
|---|---|---|---|---|---|---|---|---|---|---|
| 5-27 | " | 7 | — | — | " | 2 | " | 1 | " | 200 |
| 5-28 | " | 5 | Ni | 3 | " | 3 | " | 0.5 | " | 50 |
| 5-29 | " | 7 | — | — | " | 2 | " | 1 | " | 50 |
| 5-30 | " | — | Ni | 12 | — | — | — | — | " | 50 |

| No. | Organic Film: Main Polymer Component | Organic Film: Thickness (μ) | Corrosion Resistance of Planar Portion | Corrosion Resistance of Worked Portion | Press formability | Spot Workability |
|---|---|---|---|---|---|---|
| Example 5 | | | | | | |
| 5-1 | Urethane | 3.0 | ◎ | ○ | ○ | ○ |
| 5-2 | Epoxy | 1.0 | ◎ | ○ | ○ | ○ |
| 5-3 | " | 0.3 | ○ | ○ | ◎ | ○ |
| 5-4 | " | 0.5 | ◎ | ○ | ◎ | ○ |
| 5-5 | " | 1.0 | ◎ | ○ | ○ | ○ |
| 5-6 | " | 3.0 | ◎ | ◎ | ○ | ○ |
| 5-7 | " | 1.0 | ◎ | ○ | ◎ | ◎ |
| 5-8 | " | 1.0 | ◎ | ○ | ○ | ○ |
| 5-9 | Acrylic-Olefinic | 1.0 | ◎ | ◎ | ◎ | ◎ |
| 5-10 | Urethane | 0.3 | ○ | ○ | ◎ | ◎ |
| 5-11 | Epoxy | 1.0 | ◎ | ◎ | ○ | ◎ |
| 5-12 | " | 0.5 | ◎ | ◎ | ◎ | ◎ |
| 5-13 | " | 1.0 | ◎ | ◎ | ◎ | ◎ |
| 5-14 | " | 1.0 | ◎ | ◎ | ○ | ◎ |
| 5-15 | Acrylic | 0.7 | ◎ | ○ | ◎ | ◎ |
| 5-16 | Polyester | 1.5 | ◎ | ◎ | ◎ | ◎ |
| 5-17 | Epoxy | 1.0 | ◎ | ◎ | ◎ | ◎ |
| 5-18 | " | 1.0 | ◎ | ◎ | ◎ | ◎ |
| 5-19 | " | 1.0 | ◎ | ◎ | ◎ | ◎ |
| Comparison 5 | | | | | | |
| 5-20 | Epoxy | 1.0 | x | x | ○ | ○ |
| 5-21 | " | 1.0 | ◎ | Δ | x | ○ |
| 5-22 | " | 1.0 | Δ | Δ | x | ◎ |
| 5-23 | " | 1.0 | Δ | Δ | ◎ | ○ |
| 5-24 | " | 1.0 | ○ | Δ | ◎ | ◎ |
| 5-25 | " | 1.0 | ○ | Δ | x | ○ |
| 5-26 | " | 1.0 | ○ | x | x | ◎ |
| 5-27 | " | 1.0 | ○ | ○ | Δ | Δ |
| 5-28 | " | 0.1 | x | x | ◎ | ◎ |
| 5-29 | " | 4.0 | ◎ | ○ | x | x |
| 5-30 | " | 1.0 | Δ | x | ◎ | ◎ |

EXAMPLE 6

Preferred embodiments of electro-plating bath compositions and electro-plating conditions for obtaining the coated steel sheets according to the present invention are shown in Table 6.

Corrosion resistance was evaluated by the area of red rust after 500 hours salt spray test (JIS Z2371).

| | |
|---|---|
| less than 1%: | ◎ |
| 1%-10%: | ○ |
| 10-30%: | Δ |
| more than 30%: | X |

Surface brightness was evaluated by brightness degree (JIS Z8741, $G_s$(60°), standard value of black glass plate: 93).

| | | |
|---|---|---|
| brightness degree | not less than 50: | ◎ |
| " | not less than 20: | ○ |
| " | less than 20: | Δ |
| " | turned black: | X |

Among the coated products obtained by the examples of the present invention, those with the Cr content of not less than 5 wt.% are particularly excellent in corrosion resistance. All of the examples were excellent in the surface brightness.

As for comparison examples, No. 6-27 and 6-29 do not contain cationic polymer in the plating bath and thereby the current density is not sufficiently high, so that the Cr content in the coating is only in a trace amount and the corrosion resistance is not good. While No. 6-28 and 6-30, too, do not contain cationic polymer, since the current density is sufficiently high to increase, the Cr content and the corrosion resistance is excellent, but their surface appearance is inferior. In the comparison examples No. 6-31 and 6-32, since the ratio of $Cr^{6+}/Cr^{3+}$ in the plating bath is high, the Cr content in the primer coating is low, corrosion resistance is insufficient and surface appearance, too, is inferior. By the way, as for the current efficiency, while all the examples of the present invention show the efficiency of more than 60%, the efficiency of all the comparison examples is as low as 50% or lower.

TABLE 6

| No. | Plating Bath Composition (g/l) Anode:Pi/Ti electrode: $Zn^{2+}$ | $Cr^{3+}$ | $Cr^{4+}/Cr^{3+}$ ratio | Cation Polymer | $Ni^{2+}$, $Fe^{2+}$, $Co^{2+}$ | Fine Particle Oxide | Others | pH | Remarks |
|---|---|---|---|---|---|---|---|---|---|

TABLE 6-continued

| | | | | | | | | | | |
|---|---|---|---|---|---|---|---|---|---|---|
| Example 6 | | | | | | | | | | |
| 6-1 | 70 | 10 | 0 | PAS-2 | 2 | — | — | $Na^+$:16 | 2 | Sulfate Bath |
| 6-2 | 20 | 10 | 0.001 | " | 2 | — | — | " | " | " |
| 6-3 | 100 | 100 | 0.005 | " | 2 | — | — | " | " | " |
| 6-4 | 50 | 5 | 0.01 | " | 1 | — | — | " | " | " |
| 6-5 | 150 | 30 | 0.05 | " | 1 | — | — | " | " | " |
| 6-6 | 70 | 10 | 0.1 | " | 2 | — | — | " | " | " |
| 6-7 | 70 | 10 | 0 | " | 2 | $Ni^{2+}$:20 | — | " | " | " |
| 6-8 | 20 | 10 | 0.001 | " | 1 | " | — | " | " | " |
| 6-9 | 80 | 100 | 0.005 | " | 2 | " | — | " | " | " |
| 6-10 | 50 | 5 | 0.01 | " | 1 | " | — | " | " | " |
| 6-11 | 100 | 30 | 0.05 | " | 1 | " | — | " | " | " |
| 6-12 | 70 | 10 | 0.1 | " | 2 | " | — | " | " | " |
| 6-13 | 70 | 10 | 0 | PAS-1 | 2 | — | — | " | " | " |
| 6-14 | 70 | 10 | 0.003 | " | 1 | — | — | $K^+$:20 | " | Chrolide Bath |
| 6-15 | 70 | 10 | 0.007 | PAS-3 | 2 | — | — | $NH^{4+}$:10 | " | Sulfate Bath |
| 6-16 | 70 | 20 | 0 | PAR | 10 | — | — | $Na^+$:16 | 3 | " |
| 6-17 | 50 | 30 | 0.005 | PAS-2 | 0.01 | — | — | " | 2 | " |
| 6-18 | 50 | 30 | 0.005 | " | 10 | — | — | " | " | " |
| 6-19 | 50 | 50 | 0.005 | PAS-2 | 20 | — | $SiO_2$:10 | $Na^+$:16 | 2 | Sulfate Bath |
| 6-20 | 70 | 10 | 0.03 | PAS-1 | 2 | $Ni^{2+}$:10 | $Al_2O_2$:10 | " | " | " |
| 6-21 | 70 | 10 | 0.1 | PAS-3 | 1 | $Fe^{2+}$:10 | — | " | " | " |
| 6-22 | 70 | 10 | 0.05 | " | 2 | $Co^{2+}$:10 | — | " | " | " |
| 6-23 | 70 | 20 | 0.001 | PB | 10 | $Ni^{2+}$:30 | — | " | " | " |
| 6-24 | 50 | 30 | 0.005 | PAS-2 | 0.01 | $Ni^{2+}$:100, $Co^{2+}$:10 | — | " | " | " |
| 6-25 | 50 | 30 | 0.005 | " | 10 | $Ni^{2+}$:30, $Fe^{2+}$:10 | — | " | " | " |
| 6-26 | 50 | 50 | 0.005 | " | 20 | $Ni^{2+}$:10 | — | " | " | " |
| Comparison 6 | | | | | | | | | | |
| 6-27 | 70 | 30 | 0 | — | — | — | $TiO_2$:10 | $Na^+$:16 | 2 | Sulfate Bath |
| 6-28 | 70 | 30 | 0 | — | — | — | — | " | " | " |
| 6-29 | 70 | 30 | 0 | — | — | $Ni^{2+}$:20 | $ZrO_2$:10 | " | " | " |
| 6-30 | 70 | 30 | 0 | — | — | " | — | " | " | " |
| 6-31 | 70 | 10 | 0.2 | PAS-2 | 2 | — | — | — | " | " |
| 6-32 | 70 | 10 | 0.5 | " | 2 | $Ni^{2+}$:20 | — | — | " | " |

| | Plating Condition | | | Coating Composition (weight %) | | | | | | |
|---|---|---|---|---|---|---|---|---|---|---|
| No. | Current Density ($A/dm^2$) | Bath Temperature (°C.) | Relative Flow Velocity (m/min) | Zn | Cr | Ni, Fe, Co | Cation Polymer | Fine Particle Oxide | Corrosion Resistance | Surface Brightness |
| Example 6 | | | | | | | | | | |
| 6-1 | 150 | 60 | 90 | balance | 10 | — | 0.1 | — | ◎ | ◎ |
| 6-2 | 20 | " | " | " | 6 | — | 0.005 | — | ◎ | ◎ |
| 6-3 | 100 | " | " | " | 7 | — | 0.05 | — | ◎ | ◎ |
| 6-4 | 250 | " | " | " | 10 | — | 0.1 | — | ◎ | ◎ |
| 6-5 | 50 | " | " | " | 10 | — | 0.01 | — | ◎ | ◎ |
| 6-6 | 200 | " | " | " | 6 | — | 0.5 | — | ◎ | ○ |
| 6-7 | 150 | " | " | " | 10 | Ni:3 | 0.1 | — | ◎ | ◎ |
| 6-8 | 20 | " | " | " | 5 | Ni:3 | 0.005 | — | ◎ | ◎ |
| 6-9 | 200 | " | " | " | 7 | Ni:3 | 0.05 | — | ◎ | ◎ |
| 6-10 | 250 | " | " | " | 10 | Ni:3 | 0.1 | — | ◎ | ◎ |
| 6-11 | 50 | " | " | " | 10 | Ni:3 | 0.01 | — | ◎ | ◎ |
| 6-12 | 200 | " | " | " | 5 | Ni:3 | 0.5 | — | ◎ | ○ |
| 6-13 | 100 | " | " | " | 7 | — | 0.05 | — | ◎ | ◎ |
| 6-14 | 50 | " | " | " | 7 | — | 0.01 | — | ◎ | ◎ |
| 6-15 | 150 | " | " | " | 7 | — | 0.1 | — | ◎ | ◎ |
| 6-16 | 150 | " | " | " | 10 | — | 0.02 | — | ◎ | ◎ |
| 6-17 | 20 | " | " | " | 6 | — | 0 | — | ◎ | ◎ |
| 6-18 | 100 | " | " | " | 20 | — | 2 | — | ◎ | ◎ |
| 6-19 | 200 | 60 | 90 | balance | 30 | — | 5 | $SiO_2$:1 | ◎ | ◎ |
| 6-20 | 200 | 40 | " | " | 7 | Ni:1 | 0.2 | $Al_2O_2$:2 | ◎ | ◎ |
| 6-21 | 50 | 50 | " | " | 5 | Fe:2 | 0.01 | — | ◎ | ◎ |
| 6-22 | 100 | 70 | " | " | 7 | Co:3 | 0.05 | — | ◎ | ◎ |
| 6-23 | 150 | 60 | 200 | " | 10 | Ni:5 | 0.02 | — | ◎ | ◎ |
| 6-24 | 20 | " | 90 | " | 6 | Ni:10 Co:1 | 0 | — | ◎ | ◎ |
| 6-25 | 100 | " | " | " | 20 | Ni:5 Fe:1 | 2 | — | ◎ | ◎ |
| 6-26 | 200 | " | " | " | 29 | Ni:1 | 5 | — | ◎ | ◎ |
| Comparison 6 | | | | | | | | | | |
| 6-27 | 100 | 60 | 90 | balance | 0.01 | — | — | $TiO_2$:1 | X | ○ |
| 6-28 | 300 | " | " | " | 7 | — | — | — | ◎ | X |
| 6-29 | 100 | " | " | " | 0.01 | Ni:2 | — | $ZrO_2$:3 | X | ○ |
| 6-30 | 300 | " | " | " | 5 | Ni:3 | — | — | ◎ | X |
| 6-31 | 150 | " | " | " | 3 | — | 0.1 | — | Δ | X |
| 6-32 | 150 | " | " | " | 1 | Ni:3 | 0.1 | — | Δ | X |

EXAMPLE 7

Continuous electro-plating was done in a plating bath having the composition as in Example No. 6-1 by using an anode of Pb-5% Sn. The ratio of $Cr^{6+}/Cr^{3+}$ in the bath was measured periodically and the current density was controlled to 150 A/dm$^2$ so as to obtain a coating of 20 g/m$^2$. Until the ratio of $Cr^{6+}/Cr^{3+}$ in the bath reached to 0.1, the Cr content in the coating obtained was not less than 6 wt.% and the coating was excellent in surface brightness, but when said ratio exceeded 0.1, the Cr content in the coating was decreased and the surface brightness also deteriorated remarkably or further the surface was turned to black. At the time when the $Cr^{6+}/Cr^{3+}$ ratio in the bath reached to 0.5, the plating solution was circulated through a bath filled with Zn metal, and then the $Cr^{6+}/Cr^{3+}$ ratio was decreased. After the $Cr^{6+}/Cr^{3+}$ ratio was lowered to 0.1, the plating was done again under the above mentioned condition, and the coating with the Cr content of 7 wt.% and having excellent surface brightness could be obtained. Continuous electro-plating was done thereafter by passing the plating solution occasionally through the tank filled with metallic Zn and repeating the measurement of the $Cr^{6+}/Cr^{3+}$ ratio in the bath periodically. Thus, a coating with the Cr content of not less than 6 wt.% and excellent surface brightness could be obtained under the condition $Cr^{6+}/Cr^{3+}$ ratio in the bath was not more than 0.1.

EXAMPLE 8

With an anode of Pb-5% Sn and using a plating bath same as in Example No. 6-7, electro-plating was done under the condition of Example 7. The result was the same as in Example 7 until the $Cr^{6+}/Cr^{3+}$ ratio did not exceed 0.1. By adding $Fe^{2+}$ ion in an amount of 5 g/l to the bath at the time when the $Cr^{6+}/Cr^{3+}$ ratio reached to 0.5, the $Cr^{6+}/Cr^{3+}$ ratio lowered to 0.05, and a coating with the Cr content of 10 wt.% and having excellent surface brightness could be obtained.

As above described, it is possible according to the present invention to produce a composite electro-plated steel sheet having a primer coating comprising Zn as main constituent, containing simultaneously a large quantity of Cr and having excellent surface brightness which has been very difficult to produce by the conventional arts. The coated products according to the present invention are very suitable for the production of a rust preventing steel sheet for such uses as in automobiles, home electric appliances and constructions in which high corrosion resistance and excellent surface brightness are required.

EXAMPLE 9

A cold rolled steel sheet was subjected to alkali degreasing, acid pickling with the use of 5% sulfuric acid solution and washing with water in succession, and the resultant steel sheet was electroplated under the following conditions:

The plating bath was an acidic bath of sulfuric acid containing $Zn^{2+}$, $Cr^{3+}$, an organic polymer (such as PA with a mean molecular weight of 10,000 PAS with a mean molecular weight of 3,500 and PEG with a mean molecular eight of 1,500) and 30g/l of $Na^{+}$, at various concentrations, pHs and bath temperatures. The flow velocity of the plating solution was 60 m/min. By using the above mentioned plating bath and varying the current density and the amount of electricity passed, primer coating and a topcoat respectively varying the composition and the coating amount were applied continuously. In some instances, Zn plating or zinc-alloy plating was applied as the topcoat for comparative.

The producing condition, the coating composition and the result of the quality examination of the thus electroplated steel sheets are shown respectively in Tables 7, 8 and 9.

Zn and Cr in the coating layers were analyzed by means of the atomic absorption method, and the amount of organic polymers was recalculated from the amount of C determined by the combustion method. The method for the evaluation of the quality of the products was as follows:

(1) Chemical Treatability (i) Immersion type phosphate treatment (with the use of PB 83020 made of Japan Parkerrising & Co.) was done under the standard condition (2 minute's immersion), and the result was evaluated with the nature of the phosphate crystals formed.

| | |
|---|---|
| ○: | fine, mean diameter was less than 15 μm, |
| Δ: | coarse with the mean diameter of more than 15 μm, |
| X: | with gap or no crystals. |

(ii) Electrolysis-type chromate treatment (with the solution comprising $CrO_3$ 30 g/l and $H_2SO_4$ 0.25 g/l at 40° C.) was done under the current density of 10 A/dm$^2$ and an amount of electricity passed of 10 C/dm$^2$, and the amount of the coating film formed was evaluated.

| | |
|---|---|
| ○: | the amount of total Cr is more than 20 mg/m$^2$ |
| Δ: | the amount of total Cr is in the range of 10 mg/m$^2$–20 mg/m$^2$ |
| X: | the amount of total Cr is less than 10 mg/m$^2$. |

(2) Corrosion resistance after paint coating

The immersion type phosphoric acid treatment (the same as in the above) and the cationic electrodeposition coating (with the use of Powertop U-600 made of Japan Paint & Co.) with the thickness of 30 μm were applied. By using the samples crosscut with a depth reaching to the base metal, the cycle corrosion test was done for 30 cycles under the condition comprising:

Salt spray (by JIS Z 2371) for 8 hours
Drying (at 60° C.) for 8 hours
Wetting (at 50° C.) under the relative humidity of 95% for hours.

| | |
|---|---|
| less than 0.1 mm: | ○ |
| 0.1 mm–0.2 mm: | Δ |
| more than 0.2 mm: | X |

(3) Waterproof adhesion property

Intermediate coating and topcoat were applied further to the above mentioned test pieces to obtain a total coating thickness of 100 μm, and the resultant test pieces were immersed in distilled water at 40° C. for 500 hours. Then the thus treated test pieces were subjected to checkerboard-mesh test with a mesh of 2 mm, and the result was evaluated by means of the number of pieces peeled off:

no piece : ○
1 - 5 pieces : Δ
more than 6 pieces : ×

(4) Workability

After the cylindrical press formation with a size of 50 mm ϕ×25 mm H, a tape peeling test was done on the worked surfaces, and the result was evaluated by the weight loss.

less than 5 mg : ○
5 mg–10 mg : Δ
more than 10 mg : ×

From the reasons that Comparative Example 1 has no topcoat, the topcoat of Comparative Example 2 is high in the Cr content, the topcoat of Comparative Example 4 is high in the organic polymer content, and the adhesion amount of the topcoat as low in Comparative Example 5, all these comparative examples are inferior in their chemical treatability and waterproof adhesion property. Comparative Example 3 is inferior in the Waterproof adhesion property because the Cr content of the topcoat is low. Comparative Example 6 is low in its corrosion resistance after paint coating because the Cr content in the primer coating is low. Comparative Example 4 is also inferior in its workability because the Cr content is high in its primer coating-comparative Examples 7 and 8 are inferior in their quality after paint coating because their topcoats are conventional Zn or Zn-alloy plating.

In contrast with these comparative examples, the present inventive examples 1–20 are excellent in all the points of the chemical treatability, the quality after paint coating and the workability.

TABLE 7

| No. | Plating bath Composition (g/l) $Zn^{2+}$ | $Cr^{3+}$ | Organic polymer | Bath temp. (°C.) | pH | Current density ($A/dm^2$) Primer coating | Topcoat |
|---|---|---|---|---|---|---|---|
| Present invention | | | | | | | |
| 1 | 45 | 10 | PAS | 1 | 60 | 2 | 100 | 5 |
| 2 | " | " | " | " | " | " | " | 10 |
| 3 | " | " | " | " | " | " | " | 20 |
| 4 | " | " | " | " | " | " | " | 50 |
| 5 | 70 | 10 | PA | 5 | 60 | 2 | 150 | 10 |
| 6 | " | " | " | " | " | " | " | 30 |
| 7 | " | " | " | " | " | " | " | 50 |
| 8 | " | " | " | " | " | " | " | 70 |
| 9 | 70 | 20 | PAS | 2 | 50 | 1.5 | 70 | 20 |
| 10 | " | " | " | " | " | " | 100 | " |
| 11 | " | " | " | " | " | " | 150 | " |
| 12 | " | " | " | " | " | " | 250 | " |
| 13 | 70 | 30 | PEG | 2 | 50 | 1.5 | 50 | 30 |
| 14 | " | " | " | " | " | " | 70 | " |
| 15 | " | " | " | " | " | " | 150 | " |
| 16 | " | " | " | " | " | " | 200 | " |
| 17 | 45 | 30 | PAS | 10 | 50 | 1.0 | 40 | 10 |
| 18 | " | " | " | " | " | " | 70 | " |
| 19 | " | " | " | " | " | " | 100 | " |
| 20 | " | " | " | " | " | " | 200 | " |
| Comparative example | | | | | | | | |
| 1 | 45 | 10 | PAS | 1 | 60 | 2 | 100 | — |
| 2 | " | " | " | " | " | 2 | " | 70 |
| 3 | " | " | " | " | " | 2 | " | 2 |
| 4 | 45 | 40 | PAS | 30 | 50 | 1.0 | 200 | 100 |
| 5 | 70 | 10 | PA | 5 | 60 | 2 | 150 | 50 |
| 6 | 45 | 10 | PAS | 1 | 60 | 2 | 15 | 20 |
| 7 | " | " | " | " | " | " | 100 | (Zn plated) |
| 8 | " | " | " | " | " | " | " | (Zn-12% Ni) |

TABLE 8

| No. | Primer coating: Plating composition other than Zn (wt. %) Cr | Organic polymer | Adhesion amount ($g/m^2$) | Topcoat: Plating composition other than Zn (Wt. %) Cr | Organic polymer | Adhesion amount ($g/cm^2$) |
|---|---|---|---|---|---|---|
| Present invention | | | | | | |
| 1 | 10 | 0.1 | 20 | 0.01 | Tr | 3 |
| 2 | 10 | 0.1 | 20 | 0.1 | 0.001 | 3 |
| 3 | 10 | 0.1 | 20 | 3 | 0.03 | 3 |
| 4 | 10 | 0.1 | 20 | 5 | 0.05 | 3 |
| 5 | 7 | 0.05 | 20 | 0.05 | Tr | 0.5 |
| 6 | 7 | 0.05 | 20 | 0.5 | 0.001 | 1 |
| 7 | 7 | 0.05 | 20 | 1 | 0.01 | 3 |
| 8 | 7 | 0.05 | 20 | 2 | 0.025 | 5 |
| 9 | 5 | 0.1 | 20 | 1 | 0.02 | 3 |
| 10 | 10 | 0.2 | 20 | 1 | 0.02 | 3 |
| 11 | 20 | 0.4 | 20 | 1 | 0.02 | 3 |
| 12 | 30 | 0.6 | 20 | 1 | 0.02 | 3 |
| 13 | 5 | 0.005 | 20 | 3 | 0.003 | 1 |
| 14 | 10 | 0.01 | 20 | 3 | 0.003 | 1 |
| 15 | 15 | 0.015 | 20 | 3 | 0.003 | 1 |
| 16 | 20 | 0.02 | 20 | 3 | 0.003 | 1 |
| 17 | 5 | 0.5 | 50 | 0.1 | 0.001 | 2 |
| 18 | 10 | 1 | 40 | 0.1 | 0.01 | 2 |
| 19 | 20 | 2 | 30 | 0.1 | 0.01 | 2 |
| 20 | 30 | 5 | 10 | 0.1 | 0.01 | 2 |
| Comparative examples | | | | | | |
| 1 | 10 | 0.1 | 20 | — | — | — |
| 2 | 10 | 0.1 | 20 | 6 | 0.06 | 3 |
| 3 | 10 | 0.1 | 20 | 0.001 | Tr | 3 |
| 4 | 40 | 8 | 20 | 5 | 2 | 3 |

TABLE 8-continued

| No. | Primer coating: Plating composition other than Zn (wt. %) Cr | Organic polymer | Adhesion amount ($g/m^2$) | Topcoat: Plating composition other than Zn (Wt. %) Cr | Organic polymer | Adhesion amount ($g/cm^2$) |
|---|---|---|---|---|---|---|
| 5 | 7 | 0.05 | 20 | 1 | 0.01 | 0.1 |
| 6 | 1 | 0.01 | 20 | 3 | 0.03 | 3 |
| 7 | 10 | 0.1 | 20 | Zn | | 3 |
| 8 | 10 | 0.1 | 20 | Zn - 12% Ni | | 3 |

TABLE 9

| No. | Chemical treatability: Phosphate treatment | Chromate treatment | Corrosion resistance after painting | Waterproof adhesion property | Workability |
|---|---|---|---|---|---|
| Present invention | | | | | |
| 1 | ○ | ○ | ○ | ○ | ○ |
| 2 | ○ | ○ | ○ | ○ | ○ |
| 3 | ○ | ○ | ○ | ○ | ○ |
| 4 | ○ | ○ | ○ | ○ | ○ |
| 5 | ○ | ○ | ○ | ○ | ○ |
| 6 | ○ | ○ | ○ | ○ | ○ |
| 7 | ○ | ○ | ○ | ○ | ○ |
| 8 | ○ | ○ | ○ | ○ | ○ |
| 9 | ○ | ○ | ○ | ○ | ○ |
| 10 | ○ | ○ | ○ | ○ | ○ |
| 11 | ○ | ○ | ○ | ○ | ○ |
| 12 | ○ | ○ | ○ | ○ | ○ |
| 13 | ○ | ○ | ○ | ○ | ○ |
| 14 | ○ | ○ | ○ | ○ | ○ |
| 15 | ○ | ○ | ○ | ○ | ○ |
| 16 | ○ | ○ | ○ | ○ | ○ |
| 17 | ○ | ○ | ○ | ○ | ○ |
| 18 | ○ | ○ | ○ | ○ | ○ |
| 19 | ○ | ○ | ○ | ○ | ○ |
| 20 | ○ | ○ | ○ | ○ | ○ |
| Comparative example | | | | | |
| 1 | X | X | ○ | X | ○ |
| 2 | Δ | Δ | ○ | X | ○ |
| 3 | ○ | ○ | Δ | X | ○ |
| 4 | Δ | Δ | Δ | X | X |
| 5 | Δ | Δ | ○ | X | ○ |
| 6 | ○ | ○ | X | ○ | ○ |
| 7 | ○ | ○ | Δ | X | Δ |
| 8 | ○ | ○ | X | X | ○ |

EXAMPLE 10

A cold rolled steel sheet was subjected to alkali degreasing, acid pickling with the use of 5% sulfuric acid solution and washing with water in succession, and the resultant steel sheet was electroplated under the following conditions:

The plating bath was an acidic bath of sulfuric acid containing $Zn^{2+}$, $Cr^{3+}$, divalent iron group metal, an organic polymer (such as PA with a mean molecular weight of 10,000, PAS with a mean molecular weight of 3,500 and PEG with a mean molecular weight of 1,500) and 30 g/l of $Na^+$, with various concentrations, pHs and bath temperatures. The flow velocity of the plating solution was 60 m/min. By using the above mentioned plating bath and varying the current density and the amount of electricity passed, a primer coating and a topcoat respectively with various compositions and coating amounts were applied continuously. In some instances, Zn plating or zinc-alloy plating was applied as the topcoat for comparative.

The producing condition, the coating composition and the result of the quality examination of the thus electroplated steel sheets were shown respectively in Tables 10, 11 and 12.

Zn and Cr in the coating layers were analyzed by means of the atomic absorption method, and the amount of organic polymers was recalculated from the amount of C determined by the combustion method. The method for the evaluation of the quantity of the products was as follows:

(1) Chemical treatability (i) Immersion type phosphate treatment (with the use of PB 83020 made of Japan Parkerrising & Co.) was done under the standard condition (2 minute's immersion), and the results were evaluated with the nature of the phosphate crystals formed.

| | |
|---|---|
| ○: | fine, mean diameter was less than 15 μm, |
| Δ: | coarse with the mean diameter of more than 15 μm, |
| X: | with gap or no crystals. |

(ii) Electrolysis-type chromate treatment (with the solution comprising $CrO_3$ 30 g/l and $H_2SO_4$ 0.25 g/l at 40° C.) was done under the current density of 10 $A/dm^2$ and an amount of electricity passed of 10 $C/dm^2$, and the amount of the coating film formed was evaluated.

| | |
|---|---|
| ○: | the amount of total Cr is more than 20 $mg/m^2$ |
| Δ: | the amount of total Cr is in the range of 10 $mg/M^2$–20 $mg/M^2$ |
| X: | the amount of total Cr is less than 10 $mg/M^2$. |

(2) Corrosion resistance after paint coating

The immersion type phosphoric acid treatment (the same as in the above) and the cationic electrodeposition coating (with the use of Powertop U-600 of Japan Paint & Co.) with the thickness of 30 μm were applied. By using the samples crosscut with depth reaching to the base metal, the cycle corrosion test was done for 30 cycles under the condition comprising:

Saline water jetting (by JIS Z 2371) for 8 hours
Drying (at 60° C.) for 8 hours
Wetting (at 50° C. under the relative humidity of 95%) for 8 hours.

less than 0.1 mm : ○
0.1 mm–0.2mm : Δ
more than 0.2 mm : ×

(3) Waterproof adhesion property

Intermediate coating and topcoat were applied further to the above mentioned test pieces to obtain a total coating thickness of 100 μm, and after immersing the resultant test pieces in distilled water at 40 ° C. for 500 hours. Then the thus treated test pieces were subjected to checkerboard-mesh test with a mesh of 2 mm, and the result was evaluated by means of the number of pieces peeled off:

No piece : ○
1–5 pieces : Δ more than 6 pieces : ×

(4) Workability

After the cylindrical press formation with a size of 50 mm $\phi \times 25$ mm H, tape peeling test was done on the worked surfaces, and the result was evaluated by the weight loss:

less than 5 mg : ○
5 mg–10 mg : Δ
more than 10 mg : ×

(5) Spot weldability

Figure 2:
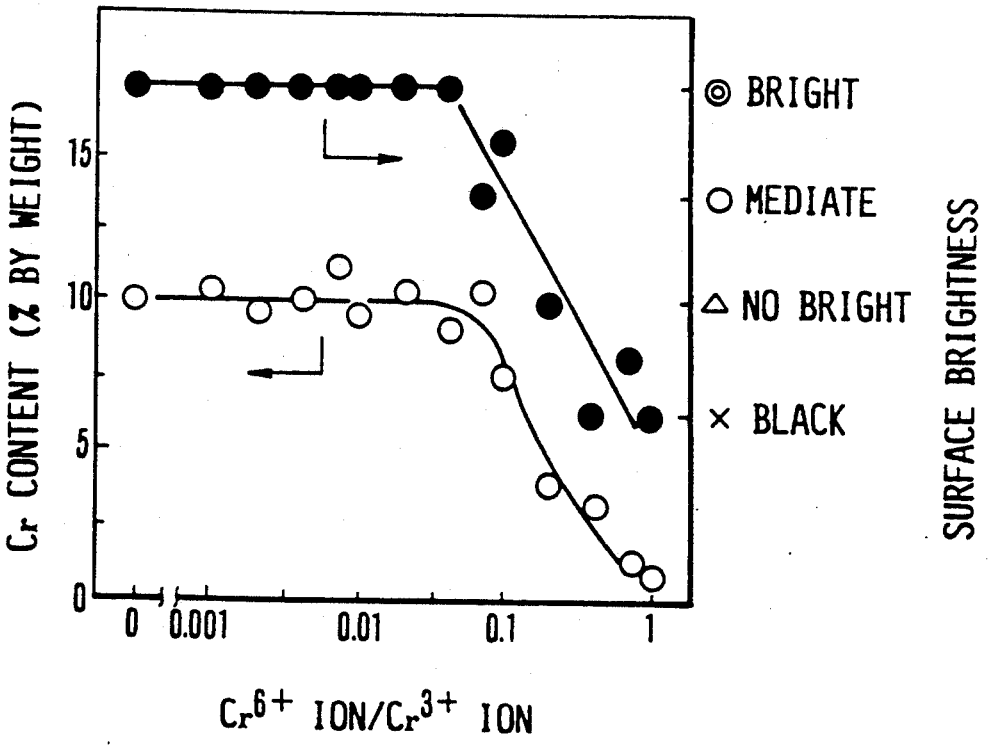
FIG. 2 is to show the correlation between the surface brightness and the Cr content and the ratio of $Cr^{6+}/Cr^{3+}$ and in a typical plating bath used in the present invention, showing that the ratio of $Cr^{6+}/Cr^{3+}$ not more than 0.1 is essential.

The condition of welding was as follows:
Electric current : 8 KA
Cycle : 10 cycles
Pressurization force : 200 kg
Shape of welding chip : as shown in FIG. 2 (12 mm $\phi$ in A, 6 mm $\phi$ in B, $\theta$ is 30%)

After continuous striking of 5000 times, the diameter of nugget was measured. The result was:

More than 3.6 mm : ○
Less than 3.6 mm : ×

From the reasons that Comparative Example 1 has no topcoat, the topcoat of Comparative Example 2 is high in the Cr content, the topcoat of Comparative Example 4 is high in the organic polymer content, and the addition amount of the topcoat is low in Comparative Example 5, all these comparative examples are inferior in their chemical treatability and waterproof adhesion property. Comparative Example 3 is inferior in the waterproof adhesion property because the Cr content of the topcoat is low. Comparative Example 6 is low in its corrosion resistance after paint coating because the Cr content in the primer coating is low. Comparative Example 4 is also inferior in its workability because the Cr content is high in its primer coating. Comparative Example 7 is inferior in its spot weldability, because the content of iron group metal is low in its primer coating. Comparative Example 8 is low in its corrosion resistance after paint coating because the content of the iron group metals in the primer coating is high. Comparative Examples 9 and 10 are inferior in their quality after paint coating because their topcoats are conventional Zn or Zn-alloy plating.

In contrast with these comparative examples, the present inventive examples 1–20 are excellent in all the points of the chemical treatability, the quality after paint coating, workability and spot weldability.

TABLE 10

| No. | Plating bath: Composition (g/l) $Zn^{2+}$ | $Cr^{3+}$ | Iron group metal | Organic high polymer | | Bath temp. (°C.) | pH | Current density ($A/dm^7$) Primer coating | Top coat |
|---|---|---|---|---|---|---|---|---|---|
| Present invention | | | | | | | | | |
| 1 | 40 | 10 | Ni 20 | PAS | 1 | 60 | 2 | 100 | 5 |
| 2 | " | " | " | " | " | " | " | " | 10 |
| 3 | " | " | " | " | " | " | " | " | 20 |
| 4 | " | " | " | " | " | " | " | " | 50 |
| 5 | 60 | 10 | Ni 30 | PA | 5 | 60 | 2 | 150 | 10 |
| 6 | " | " | Fe 30 | " | " | " | " | " | 30 |
| 7 | " | " | Co 30 | " | " | " | " | " | 50 |
| 8 | " | " | Ni 20, Co 10 | " | " | " | " | " | 70 |
| 9 | 60 | 20 | Ni 20 | PAS | 2 | 50 | 1.5 | 70 | 30 |
| 10 | " | " | " | " | " | " | " | 100 | " |
| 11 | " | " | " | " | " | " | " | 150 | " |
| 12 | " | " | " | " | " | " | " | 250 | " |
| 13 | 70 | 30 | Ni 30 | PEG | 2 | 50 | 1.5 | 50 | 40 |
| 14 | " | " | " | " | " | " | " | 70 | " |
| 15 | " | " | " | " | " | " | " | 150 | " |
| 16 | " | " | " | " | " | " | " | 200 | " |
| 17 | 40 | 30 | Ni 10 | PAS | 10 | 50 | 1.0 | 40 | 20 |
| 18 | " | " | " | " | " | " | " | 70 | " |
| 19 | " | " | " | " | " | " | " | 100 | " |
| 20 | " | " | " | " | " | " | " | 200 | " |
| Comparative example | | | | | | | | | |
| 1 | 40 | 10 | Ni 20 | PAS | 1 | 60 | 2 | 100 | — |
| 2 | " | " | " | " | " | " | " | " | 70 |
| 3 | " | " | " | " | " | " | " | " | 3 |
| 4 | 40 | 40 | Ni 20 | PAS | 30 | 50 | 1 | 200 | 100 |
| 5 | 60 | 10 | Ni 30 | PA | 5 | 60 | 2 | 150 | 50 |
| 6 | 40 | 10 | Ni 20 | PAS | 1 | 60 | 2 | 10 | 20 |
| 7 | 40 | 10 | Co 5 | PAS | 1 | 60 | 2 | 100 | 50 |
| 8 | 40 | 10 | Co 100 | PAS | 1 | 60 | 2 | 100 | 50 |
| 9 | 40 | 10 | Fe 20 | PAS | 1 | 60 | 2 | 100 | |
| 10 | 40 | 10 | Fe 20 | PAS | 1 | 60 | 2 | 100 | (Zn-12% Ni) |

TABLE 11

| No. | Primer coating: Plating composition other than Zn (wt. %) Cr | Iron group metal | Organic polymer | Adhesion amount ($g/m^2$) | Topcoat: Plating composition other than Zn (wt. %) Cr | Iron group metal | Organic polymer | Adhesion amount ($g/m^2$) |
|---|---|---|---|---|---|---|---|---|
| Present invention | | | | | | | | |
| 1 | 9 | Ni 2 | 0.1 | 20 | 0.01 | Ni 1 | Tr | 3 |
| 2 | 9 | Ni 2 | 0.1 | 20 | 0.1 | Ni 1.5 | 0.001 | 3 |
| 3 | 9 | Ni 2 | 0.1 | 20 | 3 | Ni 2 | 0.03 | 3 |
| 4 | 9 | Ni 2 | 0.1 | 20 | 5 | Ni 2 | 0.05 | 3 |
| 5 | 5 | Ni 3 | 0.05 | 20 | 0.05 | Ni 2 | Tr | 0.5 |

TABLE 11-continued

| No. | Primer coating: Plating composition other than Zn (wt. %) Cr | Iron group metal | Organic polymer | Adhesion amount ($g/m^2$) | Topcoat: Plating composition other than Zn (wt. %) Cr | Iron group metal | Organic polymer | Adhesion amount ($g/m^2$) |
|---|---|---|---|---|---|---|---|---|
| 6 | 5 | Fe 3 | 0.05 | 20 | 0.5 | Fe 1 | 0.001 | 1 |
| 7 | 5 | Co 3 | 0.05 | 20 | 1 | Co 2 | 0.01 | 3 |
| 8 | 5 | Ni 2, Co 1 | 0.05 | 20 | 2 | Ni 1, Co 0.5 | 0.025 | 5 |
| 9 | 5 | Ni 1 | 0.1 | 20 | 1 | Ni 1 | 0.02 | 3 |
| 10 | 10 | Ni 2 | 0.2 | 20 | 1 | Ni 1.5 | 0.02 | 3 |
| 11 | 20 | Ni 2 | 0.4 | 20 | 1 | Ni 2 | 0.02 | 3 |
| 12 | 28 | Ni 2 | 0.6 | 20 | 1 | Ni 2 | 0.02 | 3 |
| 13 | 5 | Ni 5 | 0.005 | 20 | 3 | Ni 5 | 0.03 | 1 |
| 14 | 10 | Ni 7 | 0.01 | 20 | 3 | Ni 5 | 0.03 | 1 |
| 15 | 15 | Ni 8 | 0.015 | 20 | 3 | Ni 5 | 0.03 | 1 |
| 16 | 20 | Ni 10 | 0.02 | 20 | 3 | Ni 5 | 0.03 | 1 |
| 17 | 5 | Ni 1 | 0.5 | 50 | 0.1 | Ni 1 | 0.01 | 2 |
| 18 | 10 | Ni 2 | 1 | 40 | 0.1 | Ni 2 | 0.01 | 2 |
| 19 | 20 | Ni 2 | 2 | 30 | 0.1 | Ni 2.5 | 0.01 | 2 |
| 20 | 28 | Ni 2 | 5 | 10 | 0.1 | Ni 3 | 0.01 | 2 |
| Comparative example | | | | | | | | |
| 1 | 9 | Ni 2 | 0.1 | 20 | — | — | — | — |
| 2 | 9 | Ni 2 | 0.1 | 20 | 6 | Ni 2 | 0.06 | 3 |
| 3 | 9 | Ni 2 | 0.1 | 20 | 0.001 | Ni 2 | Tr | 3 |
| 4 | 35 | Ni 5 | 7 | 20 | 5 | Ni 4 | 2 | 3 |
| 5 | 5 | Ni 3 | 0.05 | 20 | 1 | Ni 2 | 0.01 | 0.1 |
| 6 | 1 | Ni 2 | 0.01 | 20 | 3 | Ni 2 | 0.03 | 3 |
| 7 | 9 | Co 0.1 | 0.1 | 20 | 3 | Co 0.1 | 0.03 | 3 |
| 8 | 9 | Co 15 | 0.1 | 20 | 3 | Co 12 | 0.03 | 3 |
| 9 | 9 | Fe 2 | 0.1 | 20 | | Zn | | 3 |
| 10 | 9 | Fe 2 | 0.1 | 20 | | Zn-12% Ni | | 3 |

TABLE 12

| No. | Chemical treatability: Phosphate treatment | Chromate treatment | Corrosion resistance after painting | Waterproof adhesion property | Work-ability | Shot weldability |
|---|---|---|---|---|---|---|
| Present invention | | | | | | |
| 1 | ○ | ○ | ○ | ○ | ○ | ○ |
| 2 | ○ | ○ | ○ | ○ | ○ | ○ |
| 3 | ○ | ○ | ○ | ○ | ○ | ○ |
| 4 | ○ | ○ | ○ | ○ | ○ | ○ |
| 5 | ○ | ○ | ○ | ○ | ○ | ○ |
| 6 | ○ | ○ | ○ | ○ | ○ | ○ |
| 7 | ○ | ○ | ○ | ○ | ○ | ○ |
| 8 | ○ | ○ | ○ | ○ | ○ | ○ |
| 9 | ○ | ○ | ○ | ○ | ○ | ○ |
| 10 | ○ | ○ | ○ | ○ | ○ | ○ |
| 11 | ○ | ○ | ○ | ○ | ○ | ○ |
| 12 | ○ | ○ | ○ | ○ | ○ | ○ |
| 13 | ○ | ○ | ○ | ○ | ○ | ○ |
| 14 | ○ | ○ | ○ | ○ | ○ | ○ |
| 15 | ○ | ○ | ○ | ○ | ○ | ○ |
| 16 | ○ | ○ | ○ | ○ | ○ | ○ |
| 17 | ○ | ○ | ○ | ○ | ○ | ○ |
| 18 | ○ | ○ | ○ | ○ | ○ | ○ |
| 19 | ○ | ○ | ○ | ○ | ○ | ○ |
| 20 | ○ | ○ | ○ | ○ | ○ | ○ |
| Comparative example | | | | | | |
| 1 | X | X | ○ | X | ○ | ○ |
| 2 | Δ | Δ | ○ | X | ○ | ○ |
| 3 | ○ | ○ | Δ | X | ○ | ○ |
| 4 | Δ | Δ | Δ | X | X | ○ |
| 5 | Δ | Δ | ○ | X | ○ | ○ |
| 6 | ○ | ○ | X | ○ | ○ | ○ |
| 7 | ○ | ○ | Δ | ○ | Δ | X |
| 8 | ○ | ○ | X | Δ | Δ | ○ |
| 9 | ○ | ○ | Δ | X | Δ | ○ |
| 10 | ○ | ○ | X | X | ○ | ○ |

What is claimed is:

1. A process for producing a coated steel sheet having excellent corrosion resistance and surface brightness, comprising performing electro-plating in an acidic Zn plating bath containing Cr ions and cation polymer, with the ratio of $Cr^{6+}$ ions/$Cr^{3+}$ ions being not more than 0.1.

2. A process according to claim 1, in which the acidic bath contains at least one member selected from the group consisting of $Ni^{2+}$, $Fe^{2+}$ and $Co^{2+}$.

3. A process according to claim 1, in which the acidic bath further contains at least one oxide selected from the group consisting of oxides of Si, Al, Zr, Ti, Cr, Mo and W.

4. A process according to claim 1, in which the cation polymer is a quaternary amine polymer.

5. A process according to claim 2, in which the acidic bath further contains at least one oxide selected from the group consisting of oxides of Si, Al, Zr, Ti, Cr, Mo and W.

6. A process according to claim 2, in which the cation polymer is a quaternary amine polymer.

7. A process according to claim 3, in which the cation polymer is a quaternary amine polymer.

8. A process according to claim 5, in which the cation polymer is a quaternary amine polymer.

9. A process for producing a coated steel sheet having a primer coating and an upper coating, and having excellent corrosion resistance, comprising: a step of electroplating a steel sheet in a plating bath containing $Zn^{2+}$ ions, $Cr^{3+}$ ions and an organic polymer under a controlled current density so as to differentiate a composition of the primer coating from a composition of the upper coating.

10. A process according to claim 9 wherein the primer coating is a complex zinc coating containing 5–30% by weight of Cr, and 0.001 to 5% by weight of the organic polymer, and the upper coating is a complex zinc coating containing 0.01 to less than 5% by weight of Cr and not more than 1% by weight of the organic polymer.

11. A process according to claim 9 wherein the plating bath further contains ions of an iron group metal.

12. A process according to claim 11 wherein the primer coating is a complex zinc coating containing 5 to 30% by weight of Cr, 1 to 10% by weight of the iron group metal and 0.001 to 5% by weight of the organic polymer, and the upper coating is a complex zinc coating containing 0.001 to less than 5% by weight of Cr, 1 to 10% by weight of the iron group metal, and not more than 1% by weight of the organic polymer.

* * * * *